US010882352B2

(12) United States Patent
Boegli et al.

(10) Patent No.: US 10,882,352 B2
(45) Date of Patent: Jan. 5, 2021

(54) MICRO-EMBOSSING

(71) Applicants: Boegli-Gravures SA, Marin-Epagnier (CH); Inge REISSE, Chemnitz (DE)

(72) Inventors: Charles Boegli, Marin-Epagnier (CH); Matthias Kahl, Marin-Epagnier (CH); Günter Reisse, Chemnitz (DE); Werner Steffen, Stans (CH); Wolfgang Brickenkamp, Lüdenscheid (DE)

(73) Assignee: Boegli-Gravures SA, Marin-Epagnier (CH)

( * ) Notice: Subject to any disclaimer, the term of this patent is extended or adjusted under 35 U.S.C. 154(b) by 641 days.

(21) Appl. No.: 15/531,481

(22) PCT Filed: Dec. 21, 2015

(86) PCT No.: PCT/IB2015/059821
§ 371 (c)(1),
(2) Date: May 30, 2017

(87) PCT Pub. No.: WO2016/103144
PCT Pub. Date: Jun. 30, 2016

(65) Prior Publication Data

US 2017/0282635 A1 Oct. 5, 2017

(30) Foreign Application Priority Data

Dec. 22, 2014 (EP) ..... 14199873

(51) Int. Cl.
*B31F 1/07* (2006.01)
*B44B 5/00* (2006.01)
(Continued)

(52) U.S. Cl.
CPC ..... *B44B 5/0009* (2013.01); *A61J 1/00* (2013.01); *B31F 1/07* (2013.01); *B65D 65/406* (2013.01);
(Continued)

(58) Field of Classification Search
CPC ..... B21B 1/227; B44B 5/0009; B31F 1/07; B31F 2201/0741; B31F 2201/0733; B31F 2201/0761; B31B 50/88
See application file for complete search history.

(56) References Cited

U.S. PATENT DOCUMENTS 2,593,149 A 4/1952 Ilner
3,483,057 A 12/1969 Mittman
(Continued)

FOREIGN PATENT DOCUMENTS

AU 772613 B2 11/2000
CA 2367423 C 5/2008
(Continued)

OTHER PUBLICATIONS

European Patent Application No. 15830850.2 Office Action dated Oct. 2, 2018.
(Continued)

*Primary Examiner* — Debra M Sullivan
(74) *Attorney, Agent, or Firm* — Andre Roland S.A.; Nikolaus Schibli

(57) ABSTRACT

A method for embossing optically diffracting microstructures in a thin foil, such as used to pack at least one of the list comprising food, chocolate, chewing gum, gifts, jewellery, clothes, tobacco products, pharmaceutical products, the embossing being produced with an embossing rollers set-up comprising at least one cylindrical embossing roller and a cambered counter roller. The method comprises confining the at least one cylindrical embossing roller and the cambered counter roller in a single roller stand of relatively small outer dimensions designed to withstand a pressure for the at least one cylindrical embossing roller and the cambered counter roller; using on a surface of a first one of the at least one cylindrical embossing rollers at least one raised embossing element adapted for microstructure embossing,
(Continued)

whereby one of the at least one raised embossing elements comprises a platform distant at a height in a range between 5 m and 30 m above a surrounding surface of the first cylindrical embossing roller adjacent to it, and a pattern engraved on top of the platform (5), whereby the pattern comprises the optically diffracting microstructures with periodicity of gratings in the range smaller than 30 μm that produce from a diffuse or directed source of light in the visible wavelength range diffraction images with high contrast and high luminosity in a defined observation angle; and adjusting the pressure for the at least one cylindrical embossing roller on the thin foil in a range less than 80 bar relative to a platform area of approximately 100 $mm^2$.

16 Claims, 47 Drawing Sheets

(51) Int. Cl.

| | |
|---|---|
| ***A61J 1/00*** | (2006.01) |
| ***B65D 65/40*** | (2006.01) |
| ***B65D 85/18*** | (2006.01) |
| ***B65D 85/60*** | (2006.01) |
| *B31B 50/88* | (2017.01) |

(52) U.S. Cl.
CPC ..... *B65D 85/18* (2013.01); *B65D 85/60* (2013.01); *B31B 50/88* (2017.08); *B31F 2201/0733* (2013.01); *B31F 2201/0753* (2013.01); *B31F 2201/0761* (2013.01)

(56) References Cited

U.S. PATENT DOCUMENTS

| | | | |
|---|---|---|---|
| 5,007,271 | A | 4/1991 | Boegli |
| 5,598,774 | A | 2/1997 | Boegli |
| 5,882,750 | A | 3/1999 | Dell |
| 6,176,819 | B1 | 1/2001 | Boegli et al. |
| 6,665,998 | B1 | 12/2003 | Boegli |
| 6,715,411 | B1 | 4/2004 | Boegli |
| 6,733,626 | B2 | 5/2004 | Ruthven et al. |
| 7,036,347 | B2 | 5/2006 | Boegli |
| 7,147,453 | B2 | 12/2006 | Boegli |
| 7,229,681 | B2 | 6/2007 | Boegli |
| 7,624,609 | B2 | 12/2009 | Ball |
| 8,038,922 | B2 | 10/2011 | Boegli |
| 8,430,663 | B2 | 4/2013 | Boegli |
| 8,495,900 | B2 | 7/2013 | Boegli |
| 8,932,044 | B2 | 1/2015 | Boegli |
| 9,140,834 | B2 | 9/2015 | Boegli |
| 9,156,107 | B2 | 10/2015 | Boegli et al. |
| 9,180,643 | B2 | 11/2015 | Boegli |
| 9,481,141 | B2 | 11/2016 | Boegli |
| 9,505,167 | B2 | 11/2016 | Boegli |
| 9,579,924 | B2 | 2/2017 | Boegli |
| 9,636,885 | B2 | 5/2017 | Boegli et al. |
| 9,809,927 | B2 | 11/2017 | Boegli |
| 9,939,725 | B2 | 4/2018 | Boegli et al. |
| 9,993,895 | B2 | 6/2018 | Boegli et al. |
| 10,083,253 | B2 | 9/2018 | Boegli et al. |
| 10,183,318 | B2 | 1/2019 | Boegli et al. |
| 2005/0199141 | A1 | 9/2005 | Uglow |
| 2005/0279147 | A1 | 12/2005 | Boegli |
| 2005/0280182 | A1 | 12/2005 | Boegli |
| 2006/0123867 | A1* | 6/2006 | Ball ..... B21B 1/227 72/197 |
| 2008/0060405 | A1 | 3/2008 | Ball et al. |
| 2009/0226670 | A1* | 9/2009 | Schutz ..... B31F 1/07 428/154 |
| 2010/0061619 | A1 | 3/2010 | Boegli |
| 2012/0018993 | A1 | 1/2012 | Boegli et al. |
| 2012/0292821 | A1 | 11/2012 | Boegli |
| 2014/0059977 | A1 | 3/2014 | Boegli |
| 2016/0075077 | A1 | 3/2016 | Boegli et al. |
| 2017/0066079 | A1 | 3/2017 | Boegli et al. |
| 2018/0220698 | A1 | 8/2018 | Boegli et al. |
| 2018/0370175 | A1 | 12/2018 | Boegli et al. |

FOREIGN PATENT DOCUMENTS

| | | | |
|---|---|---|---|
| CA | 2382597 | A1 | 11/2008 |
| CN | 102069588 | | 5/2001 |
| DE | 202017105458 | U1 | 12/2017 |
| EP | 1181152 | | 3/2004 |
| EP | 2314447 | A2 | 4/2011 |
| EP | 2572820 | A1 | 3/2013 |
| EP | 2653301 | A1 | 10/2013 |
| EP | 3300612 | A1 | 4/2018 |
| EP | 3415306 | A1 | 12/2018 |
| WO | WO 2007/012215 | | 2/2007 |
| WO | WO 2017208092 | | 7/2017 |

OTHER PUBLICATIONS

Russian Patent Application No. 2017124393 Office Action dated Jan. 25, 2019.

EPO the minutes of the oral proceedings before the Examining Division for Application No. 15830850.2 dated Oct. 16, 2019.

EPO decision to refuse EP Application No. 15830850.2 dated Nov. 25, 2019.

RuPTO Search Report for Russian Application No. 2017124393 dated Dec. 21, 2015.

* cited by examiner (1)

(2)

(1)

(2)

(3)

(1)

(2)

(3)

(1)

(2)

(3)

(1)

(2)

(1)

(2)

(1)

(2)

10°

20°

30°

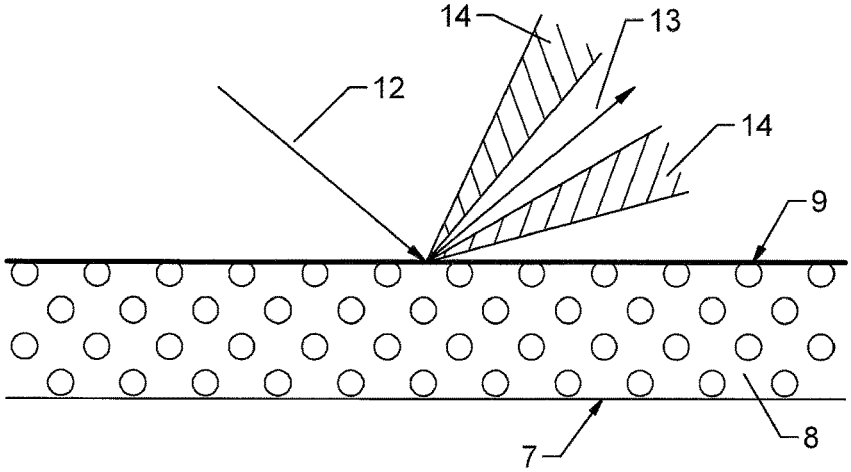
Fig.58.a
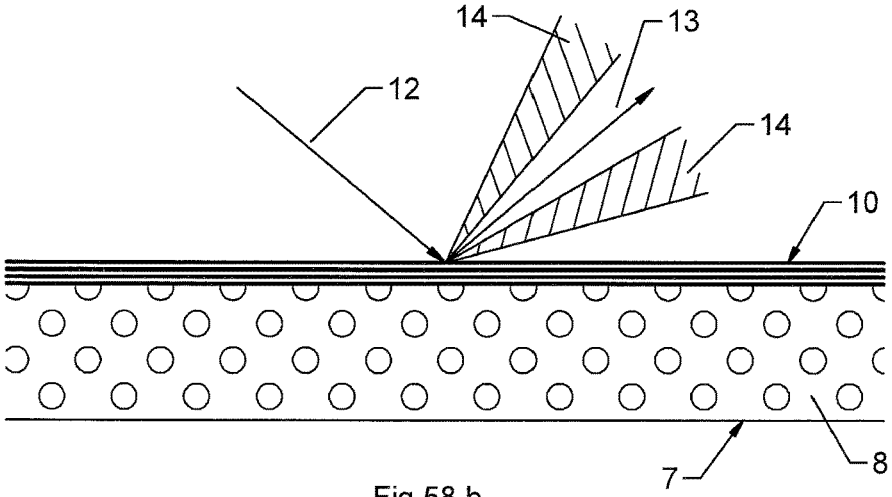
Fig.58.b
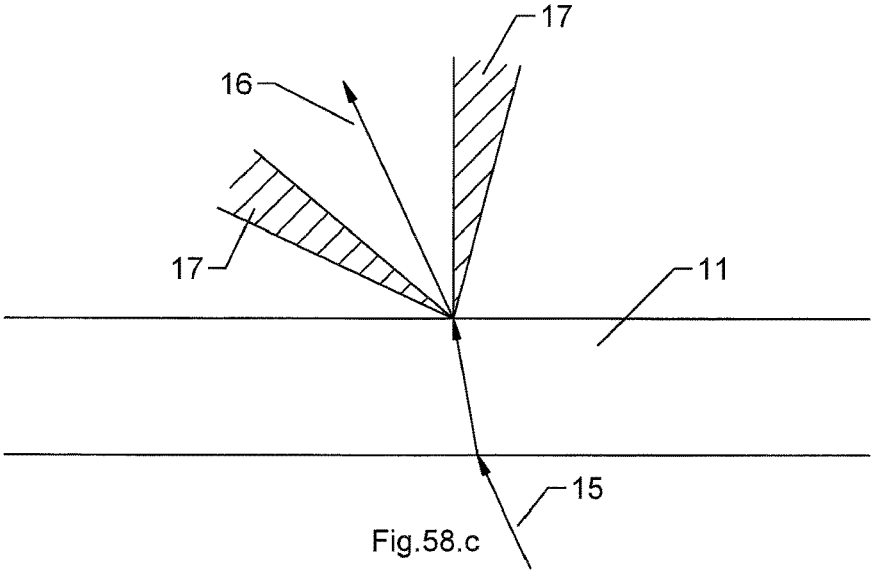
Fig.58.c

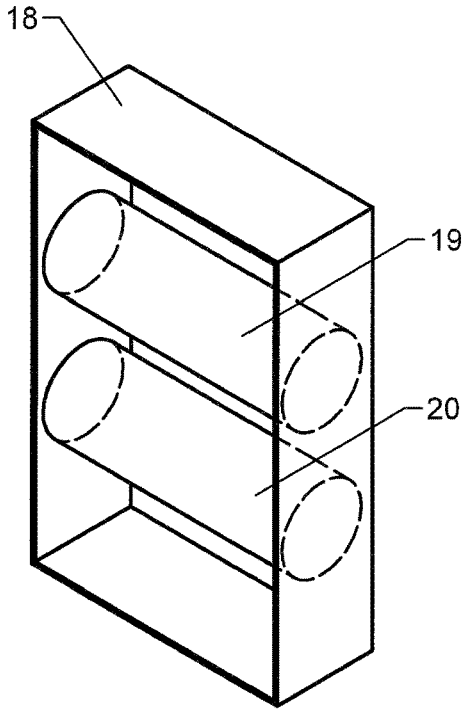
Fig.59.a
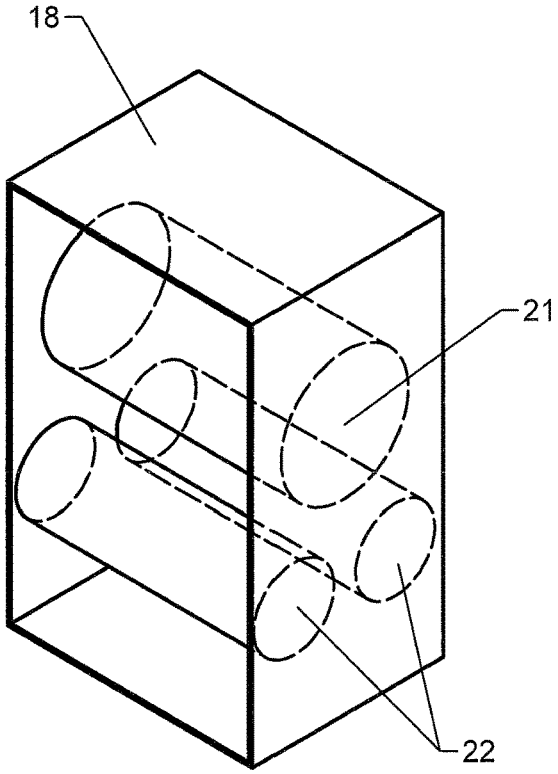
Fig.59.b

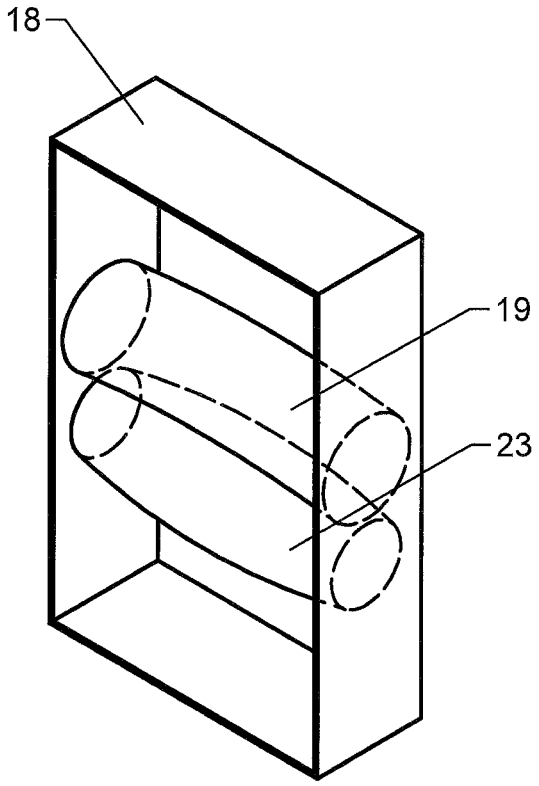
Fig.59.c

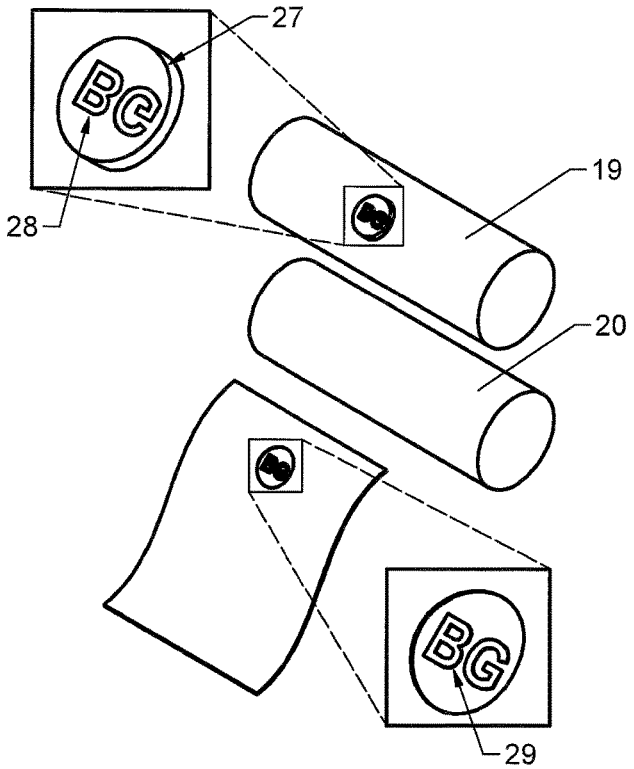
Fig.60.a
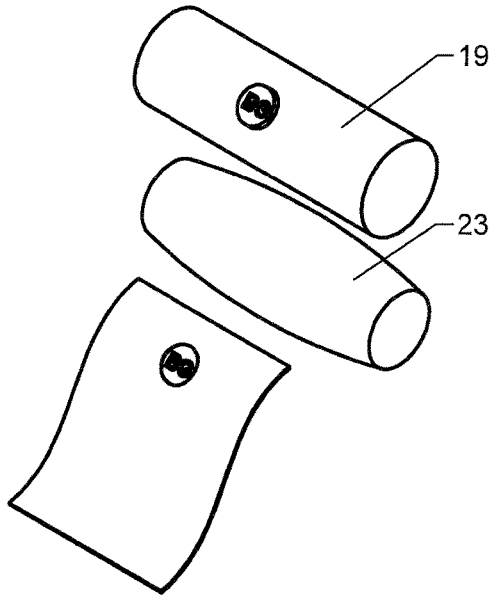
Fig.60.b
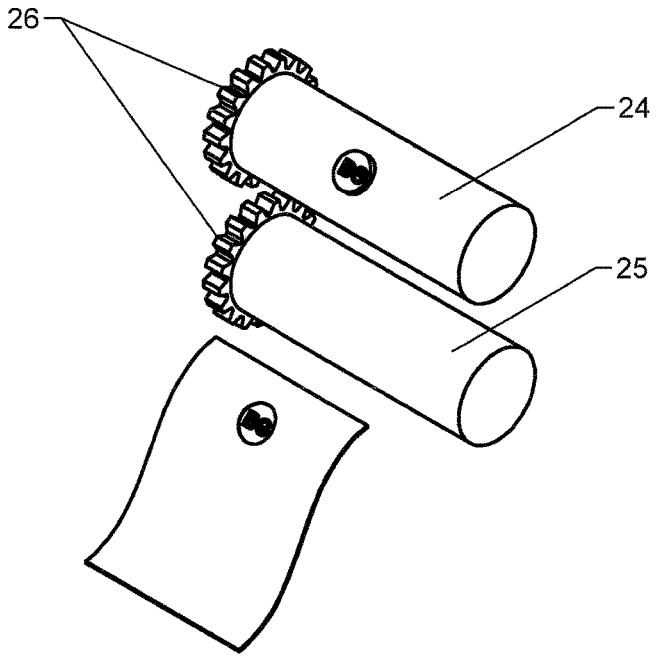
Fig.60.c

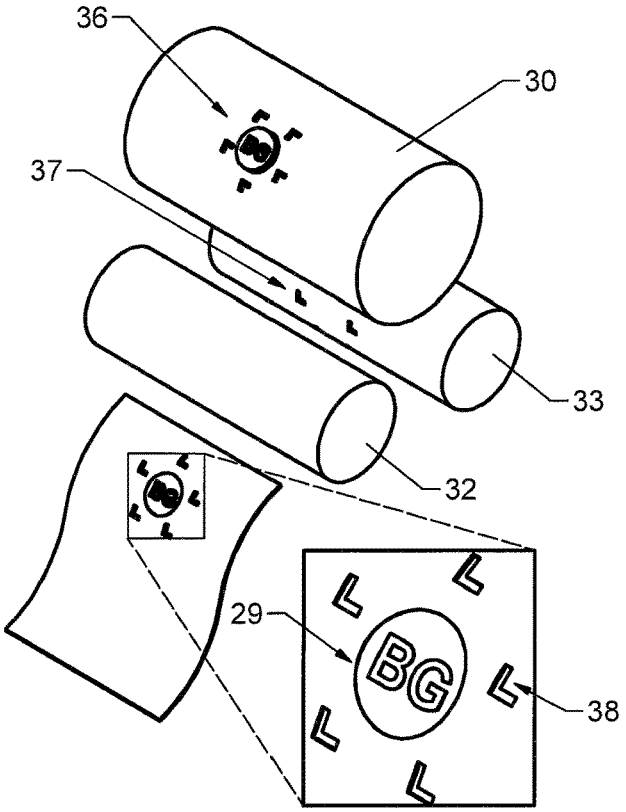
Fig.61.a
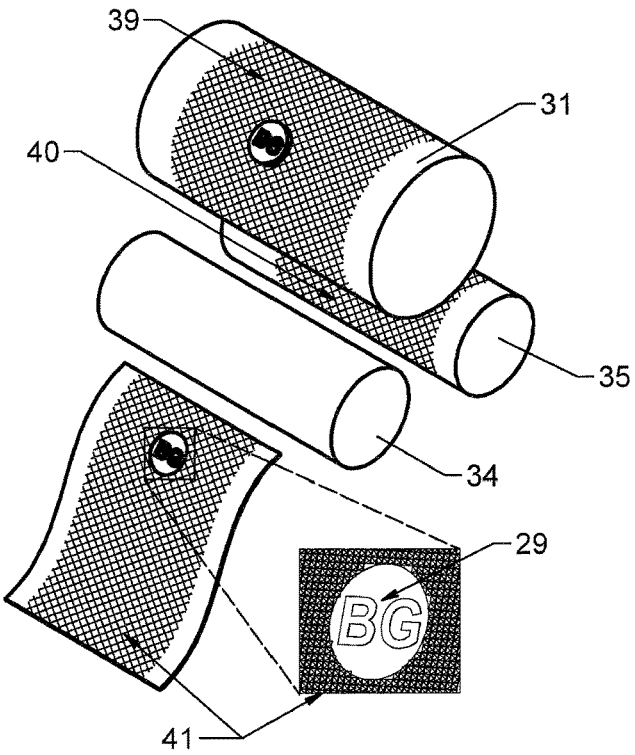
Fig.61.b

MICRO-EMBOSSING

CROSS REFERENCE TO RELATED APPLICATIONS

The present application is a U.S. national stage application of International patent application PCT/IB2015/059821 filed on Dec. 21, 2015 designating the United States, and claims foreign priority to European patent application EP 14199873.2 filed on Dec. 22, 2014, the contents of both documents being herewith incorporated by reference in their entirety.

FIELD OF THE INVENTION

The invention relates to micro-embossing with an embossing roller on thin industry papers such as inner liners, i.e., cigarette pack inner liner. Micro-embossing relates to the creation of embossment with sizes—periodicity of diffraction gratings—in the range smaller than 30 μm.

BACKGROUND

Micro-embossing of paper is commonly known and described, for example in U.S. Pat. No. 5,862,750 to Dell'Olmo.

In Dell'Olmo, the embossing parameters are as follows:

- the processing temperature for embossing must be set between 90° C. and 220° C.;
- an appropriate level of humidity must be provided;
- the applied surface pressure is about 20 to 120 kg/mm$^2$ between two rollers. Converted into another unit, this corresponds to a force of about 1200 N.

The embossing parameters of Dell'Olmo limit the production rate and speed because of the heating, humidifying and de-humidifying cycle. This production rate typically reaches approximately 60 m per minute.

The embossing processing device of Dell'Olmo has outer dimensions comparable to that of a room because the device requires a humidifying station and a drying station to reach the required humidity parameters for the paper.

The international publication WO 2006/016004 A1 describes a complex alternative to what is known from U.S. Pat. No. 5,862,750. However to the knowledge of the inventors, this has never been realized in production.

In this prior art reference, embossing parameters may be as follows:

- the embossing requires heating which is for example achieved using infrared heaters, and the temperature is measured with pyrometric measuring devices;
- embossing pressure may be 0.6 MPa. This corresponds to about 0.06 kg/mm$^2$.

While the embossing parameters are much easier to realize than in U.S. Pat. No. 5,862,750, e.g., less heating, less pressure, the process of Avantone remains prohibitively complicated due to the process of photolithography employed.

Publication U.S. Pat. No. 7,624,609 B2 discloses a system for roll embossing of discrete features. Various embodiments of the system are discussed in which a patterning feature is left displaced from the remaining cylindrical part of the work roll, thereby creating a localized surface region in the form of a plateau feature. The system allows to cause an intensification of the pressure that is localized to the surface region in form of the plateau feature, this local increase in pressure resulting in an improved pattern transfer across the plateau feature. According to the applicant the contact pressures are then sufficient to allow the transfer of very fine scale topographic features, for example diffraction gratings.

The described process omits to disclose essential parameters such as quality of bulk foil or inner liner material and requires a plurality of roller stands, hence preventing useful application for industrial applications.

Items to be embossed may generally be either inner liners—cigarette pack inner liners—or foils, which may generally be called thin foils.

Foils typically may have a thickness from about 5 μm to about 400 μm and may be thin metal foils, e.g., aluminum foils, laminates made out of paper and/or plastic layers and metal foils, and metallized paper or metallized laminates similar substances.

Such foils may in some cases be used as inner liners, which are used, e.g., in cigarette packaging—cigarette pack inner liners—and may be made out of metal coated paper, e.g., vapor coated base paper or aluminum layered paper.

Such foils may be metallic pieces in shape of eleongated stripes to be microembossed and subsequently processed.

These foils and inner liners are thus thin and relatively un-elastic, i.e, very hard. They are often particularly adapted for food safe packaging because they are to a high degree impermeable to water vapor.

Foils and inner liners can be directly and quickly embossed using rollers with hard steel surfaces, such as is the case in the above cited Dell'Olmo prior art.

In addition to the embossing problems encountered in Dell'Olmo, a number of further problems are found when producing custom shaped patterns on inner liners by means of embossing, which result in an insufficient quality.

Custom shaped patterns may occupy a relatively large surface, and high pressure required for the embossing of such patterns may affect the sandwiched layer structure of the inner liners. At high temperature the affected sandwiched layer structure becomes damaged and causes a lacquer stain to occur on the back side of the paper.

In case a plurality of custom shaped patterns are embossed on the same surface of the inner liner, the paper may easily wrinkle due to a variable local extension of the paper. This is particularly troublesome as the density of custom shaped patterns increases.

Various solutions have been proposed in prior art to address the problem of a constant esthetically pleasing embossing of custom patterns and the problem of wrinkling. For example, US patent publication US 2008060405 A1 and international publication WO 93 23197 A1 disclose solutions that allow obtaining a desirable density of patterns which is relatively high. However these solutions restrict themselves to niche applications, such as the embossing of bank notes, but are inadequate for an industrial use, such as for example in the tobacco industry.

SUMMARY OF THE INVENTION

It is an aim of the present invention to address the problems encountered in prior art embossing methods and devices. This is in particular achieved through an appropriate adjustment of the embossing parameters—particularly relatively low embossing forces and pressures at room temperature to avoid pre-heating, accordingly choosing adequate roller manufacturing and surface technology and adequate inner lining or foil materials, and also choosing specific geometries and sizes of gratings to obtain good quality embossing results.

In a first aspect, the invention provides a method for embossing optically diffracting microstructures in a thin foil, such as used to pack at least one of the list comprising food, chocolate, chewing gum, gifts, jewellery, clothes, tobacco products, pharmaceutical products, the embossing being produced with an embossing rollers set-up comprising at least one cylindrical embossing roller and a cambered counter roller. The method comprises confining the at least one cylindrical embossing roller and the cambered counter roller in a single roller stand of relatively small outer dimensions designed to withstand a pressure for the at least one cylindrical embossing roller and the cambered counter roller; using on a surface of a first one of the at least one cylindrical embossing rollers at least one raised embossing element adapted for microstructure embossing, whereby one of the at least one raised embossing elements comprises a platform distant at a height in a range between 5 μm and 30 μm above a surrounding surface of the first cylindrical embossing roller adjacent to it, and a pattern engraved on top of the platform, whereby the pattern comprises the optically diffracting microstructures with periodicity of gratings in the range smaller than 30 μm that produce from a diffuse or directed source of light in the visible wavelength range diffraction images with high contrast and high luminosity in a defined observation angle; and adjusting the pressure for the at least one cylindrical embossing roller on the thin foil in a range less than 80 bar relative to a platform area of approximately 100 $mm^2$.

In a preferred embodiment the method further comprises selecting the thin foil from one or more of the list comprising: thin metal foil, laminate made out of a paper and/or at least a plastic layers and a least a metal foil having different dielectric behavior.

In a further preferred embodiment the thin foil is a laminate that comprises paper and a metal foil or plastic film, and has a grammage of about 20 to 90 $g/m^2$.

In a further preferred embodiment the thin foil is a laminate that comprises a metallized paper or a metallized plastic film, and has a grammage of about 40 to 90 $g/m^2$.

In a further preferred embodiment the thin foil is made of aluminum.

In a further preferred embodiment the method further comprises providing on the surface of a further one of the at least one cylindrical embossing rollers, a macro-pattern arranged to emboss satinating macro-structures on the thin foil.

In a further preferred embodiment the macro-pattern is obtained by a pin-up, pin-up embossing.

In a second aspect the invention provides a use of a thin foil from one of the list at least comprising thin metal foil, laminate made out of paper and/or at least a plastic layer and at least a metal foil, in an embossing process with at least one cylindrical embossing roller and a cambered counter roller. The use comprises confining the at least one cylindrical embossing roller and the cambered counter roller in a single roller stand enclosure of relatively small outer dimensions designed to withstand a pressure for the at least one cylindrical embossing roller and the cambered counter roller; using on a surface of the at least one cylindrical embossing rollers at least one raised embossing element adapted for microstructure embossing, whereby one of the at least one raised embossing elements comprises a platform distant at a height in a range between 5 μm and 30 μm above a surrounding surface of the at least one cylindrical embossing roller adjacent to it, and a pattern engraved on top of the platform, whereby the pattern comprises optically diffracting microstructures with periodicity of gratings in the range smaller than 30 μm that produce from a diffuse or directed source of light in the visible wavelength range diffraction images with high contrast and high luminosity in a defined observation angle; and adjusting the pressure for the at least one cylindrical embossing roller on the thin foil in a range less than 80 bar relative to a platform area of approximately 100 $mm^2$.

BRIEF DESCRIPTION OF THE SEVERAL VIEWS OF THE DRAWINGS

The invention will be better understood in light of the description of preferred embodiment and in view of the appended drawings, wherein FIGS. 1(1) to 1(10) illustrate example of basic geometrical shapes used a variations of gratings;

FIGS. 58*a* and 58*b* show example variations of a material to be embossed;

FIG. 58*c* shows a further example of a material to be embossed;

FIGS. 59*a*, 59*b* and 59*c* contain schematic illustration of roller stands that may be used in the invention;

FIGS. 60*a*, 60*b* and 60*c* represent possible examples of configuring embossing rollers; and FIGS. 61*a* and 61*b* show two example embodiments of embossing rollers each comprising 3 embossing rollers.

DETAILED DESCRIPTION OF THE PREFERRED EMBODIMENTS

Figure 1:
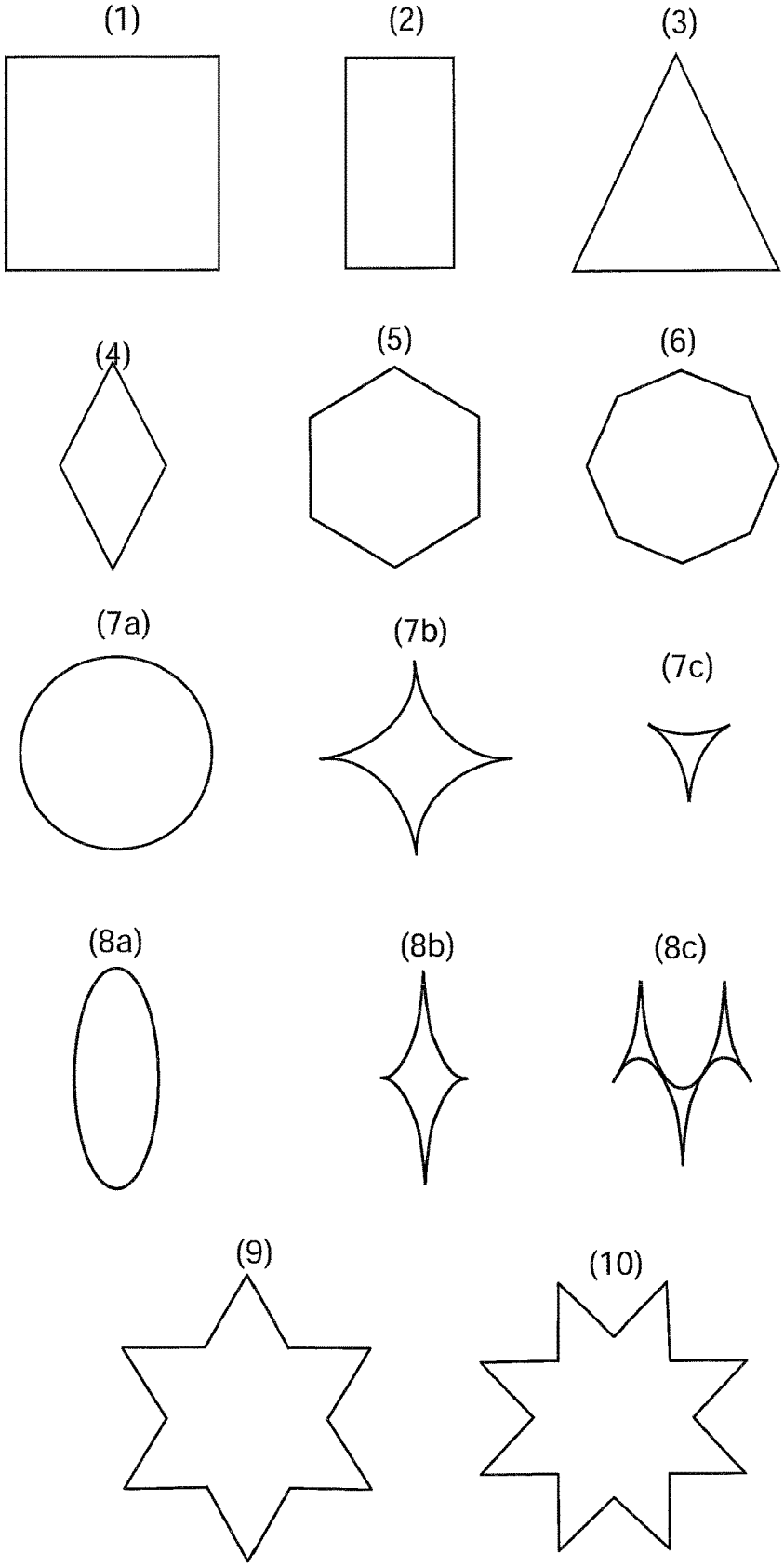

A surface of a micro-embossing roller for embossing a thin foil comprises at least one raised embossing element. The raised embossing element comprises a platform that is distant from the surface of the embossing roller adjacent to the raised embossing element by a distance between 5 μm and 30 μm. A pattern intended to be embossed on the thin foils is engraved on top of the platform. This pattern is typically a light diffracting one using gratings.

The effect of using the raised embossing element is that the total force required to be applied on the embossing roller may be reduced for a same local embossing pressure—as compared to having the pattern directly on the surface of the embossing roller.

Optionally it is possible to have on the surface of the embossing roller surrounding the raised embossing element, or between a plurality of raised embossing elements, additional structures with the aim of glazing the thin foil. This has the effect, when looking at light reflected from the embossed thin foil, on one hand of providing an improved difference of contrast between parts embossed with the raised embossing elements and parts glazed, and on the other hand of improving the perceived brilliance of diffracted patterns.

The invention requires a hard and elastic embossing surface in order to perform high speed rotational embossing. An example of speeds to be achieved corresponds to the embossing of inner liners for approximately 1000 packs of cigarettes per minute.

International publication WO 2010/111798 A1 and International publication WO 2010/111799 A1—both to the applicant of the present invention, and incorporated herein by reference—disclose to use the super hard material ta-C as layer for embossing rollers, the layer being deposited as a coating, whereby the super hard material ta-C stands for hard materials representatively.

The super hard ta-C layer is an amorphous carbon film, which has shown to be very suitable for various applications, more particularly for tribological applications but also for optical diffraction applications. In particular the ta-C layer enables laser engraving to be made without deterioration of the surface by heat conduction or the like.

The publications discuss machining parameters appropriate for structuring the ta-C layer on the embossing roller, whereby lasers are used.

More precisely two lasers are used for micro- and nano-structuring the ta-C layers on the embossing rollers. The first laser, e.g., a KrF excimer laser having a wave-length of 248 nm, produces microstructures in the ta-C layer according to the mask projection technique, and the second laser, a femtosecond laser having a center wavelength of 775 nm, produces nanostructures in the ta-C layer according to the focus technique.

The microstructures produced may be, e.g., trench-shaped grating structures having grating periods of 1 to 2 μm, and the nanostructures may be, e.g., self-organized ripple structures having periods of approximately 700 nm which act as an optical diffraction grating. In this respect, any periodic array of the optical diffraction active structures is possible that produces angular-dependent dispersion, i.e., a separation into spectral colors, by diffraction upon irradiation with poly-chromatic or white light.

For the microstructures, the following machining parameters are disclosed, e.g., appropriate for structuring the ta-C layer on the embossing roller: pulse repetition frequency of the excimer laser 30 Hz, laser beam fluence on the layer 8 J/cm$^2$, number of laser pulses per basic area 10. The term basic area is used here to designate the surface on the embossing roller or embossing die that is structured by the laser beam shaped by the mask and the diaphragm and imaged onto the ta-C coated embossing roller surface in a laser beam pulse train (pulse sequence) without a relative movement of the laser beam and the roller surface.

Microstructured ripples are produced in the ta-C layer on the embossing roller by scanning the surface line-by-line, the line offset being preferably chosen such that the line spacing corresponds to the spacing of the individual pulses along the line. More precisely, ripples result from a self-organizing effect caused by laser irradiation at a determined wavelength. The width and depth of the ripple related microstructures depend on the wavelength but also other parameters.

Microstructures may further be produced by means of direct writing with a laser beam.

The invention requires a method for producing a structured surface on a steel embossing roller.

International publication WO 2013/041430 A1—to the applicant of the present invention, and incorporated herein by reference—discloses such method for producing the structured surface the steel embossing roller.

More precisely the problem addressed in WO 2013/041430 A1 is to produce fine surfaces with macrostructures on steel embossing rollers fast and precisely, thereby allowing a great diversity of design possibilities, e.g., variable tooth spacing and shapes, as well as the industrial manufacture of male-female rollers as well as a versatile application for the most diverse foil materials.

The invention described in WO 2013/041430 A1 indicates which particular parameters may be adopted for a suitable control of the ablation process under specific conditions. WO 2013/041430 A1 describes a parameter combination that enables one skilled in the art to implement the engraving of steel rollers in the reproduction accuracy and quality required for micro-embossing technology.

For example WO 2013/041430 A1 describes a method for producing a structured surface on a steel embossing roller by means of short pulse laser, the structuring being a micro-structuring with dimensions of about 20 μm.

The invention requires a housing with a set of embossing rollers wherein very high pressures may be achieved.

Embossing housings normally lodge the embossing rollers that stand under mutual pressure. The housing may also be designated either as roller stand, roller frame or embossing head. Throughout the description the term roller stand will be used.

International publication WO 2014/045176 A2—to the applicant of the present invention, and incorporated herein by reference—discloses a roller stand and set of embossing rollers, and a method for obtaining such a set of cooperating embossing rollers.

In the method for producing a set of cooperating embossing rollers, a modeling device is used for parameterizing the embossing rollers, the device comprising a test bench having a pair of rollers which are put under hydraulic pressure that can be measured and set, in order to determine from the measurement data the parameters for producing the embossing rollers. The use of the modeling device for obtaining the parameters for producing the set of embossing rollers makes it possible to use a very large variety of embossing patterns and foils with diverse properties as a basis and, by conducting tests on this very test bench, be able to efficiently narrow down and predetermine the properties of a final embossing device, preferably operated without hydraulics.

One embodiment of the modeling device in WO 2014/045176 A2 has two rollers with hardened metal axis that have hydrostatic bearings and pressure bags, and makes it possible by adjusting the hydraulic pressure exerted on the bearings and pressure bags, to determine the bending of the axis. The optimal contact pressure is esthetically adjusted through trial with a pattern corresponding to the embossing roller and the foil to be used, and the hydraulic counter pressure is measured in the bearings and pressure bag. From this obtained data about the embossing roller stand it is possible to compute the parameters for the geometry of the embossing and counter rollers of the commercial embossing head to be realized. The assessment of the quality and the rating of the embossing is made by optical means by comparing the desired optical effect on the embossing roller and the esthetic result at the embossing on the foil.

The aim of the computing is to determine the geometry of the rollers in the final pure mechanical roller stand, corresponding to the embossing rollers in such a manner that when a determined foil is embossed with a determined embossing structure, even if very small embossing elements and high embossing pressures are used, a homogenous embossing is achieved across the whole width of the foil. A camber of one of the embossing rollers will help compensate the mechanically caused bending of the rotation axis. This way a continuous pressure may be achieved throughout the whole surface of the embossing rollers.

The technology described in WO 2014/045176 A2 enables very high pressures, no required heating of the roller, relatively small outer dimensions of the roller stand that makes it possible to use this in industrial production chains, e.g., in the tobacco industry. In a preferred embodiment, the relatively small outer dimensions of the roller stand are approximately 20×40×60 cm.

The desired pressure for realizing the present invention lies around 15000 N for each bearing on a surface of 150 mm long and 1 mm wide—the roller would have a diameter of about 700 mm.

The invention provides a method for embossing thin foils with at least a diffraction pattern engraved on a raised embossing element of the embossing roller. The thin foils to emboss may be packaging material consisting of foils or cigarette pack inner liner. The embossed thin foils may be used to pack food, chocolate, chewing gum, gifts, jewelry, clothes, tobacco products, pharmaceutical products, etc.

The inventive method for embossing operates at room temperature. The embossing roller device used to implement the method for embossing comprises in a preferred embodiment a pair of rollers, whereby

- a first one of the rollers which has a smooth surface and is cambered, and
- a second one of the rollers also has a partially smooth surface with exception of at least the raised embossing element on top of which the pattern to be embossed is engraved.

The embossing roller device can for example be modeled and realized by making use of the technology known from WO 2014/045176 A2, which is briefly discussed in a section herein above. This allows in particular to model and realize the first roller and the second roller, such that the pressure required for embossing the pattern may be obtained. In a preferred embodiment the second roller may be the driving motorized roller.

The pattern on top of the at least one raised embossing element may be realized using technology from WO 2010/111798 A1, WO 2010/111799 A1 and WO 2013/041430 A1, which is also briefly discussed in corresponding section herein above. In particular this includes providing a hard material surface on top of the raised embossing element, made for example of a ta-C layer. Also this includes engraving the hard material surface by making use of mask projection technique and/or focus technique for microscopic structures, and/or macro structuring techniques, as described and known from WO 2010/111798 A1, WO 2010/111799 A1 and WO 2013/041430 A1.

The raised embossing element's platform has a height in a range between 5 μm and 30 μm above the adjacent surrounding surface of the roller.

The pattern obtained by engraving the hard material surface of the platform comprises optically diffracting micro-structure, examples of which are described in a dedicated section of the present description.

FIGS. 1 to 49 refer to examples of basic geometrical shapes used as variations of gratings and will be discussed later on.

However FIGS. 50 to 61*b* directly refer to the described embodiments of the invention.

Figure 50:
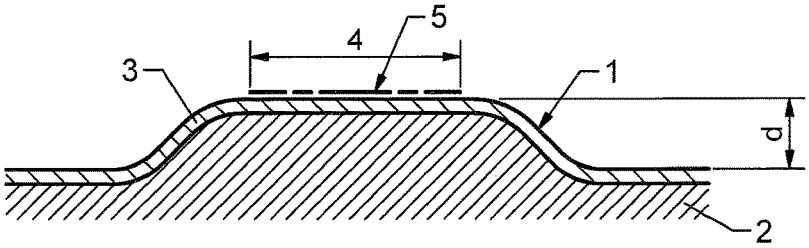
FIG. 50 illustrates an example embodiment for a raised embossing element according to the invention.

FIG. 50 illustrates an example embodiment for the raised embossing element 1 protuberating on a surface 2 of the embossing roller (not shown as a whole in FIG. 50). The surface 2 is made for example of steel. The surface 2 and the raised embossing element 1 are covered by the layer of hard material 3, for example the ta-C material. The raised embossing element 1 comprises the platform 5 having a width 4 represented by a double arrow for a better understanding. The platform 5 is distant at a height d having a value in a range between 5 μm and 30 μm, above a surrounding surface of the embossing roller adjacent to it, and in FIG. 1 also covered with the layer of hard material. The platform 5 comprises the pattern engraved on it, i.e., comprising optically diffracting micro-structures (not shown in FIG. 1). At a time of embossing, the platform 5 allows to achieve a higher embossing pressure, which renders the transfer of the micro-structures in the material to be embossed more effective. The pressure becomes less on the flanks of raised embossing element 1. In the areas of the flanks a good resolution of the structure to be embossed is strongly dependent of the shape of the flanks.

Figure 51:
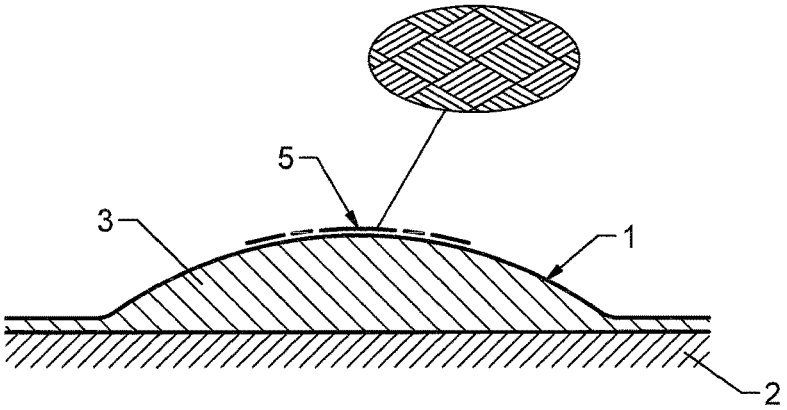
FIG. 51 illustrates a further example embodiment for the raised embossing element according to the invention.

FIG. 51 illustrates a further example embodiment for the raised embossing element 1, wherein the raised embossing element 1, rather than being built on a protuberance of the material of surface 2 as shown in FIG. 50, is built on a protuberance of the hard material 3 formed above an otherwise substantially flat surface 2.

Figure 52:
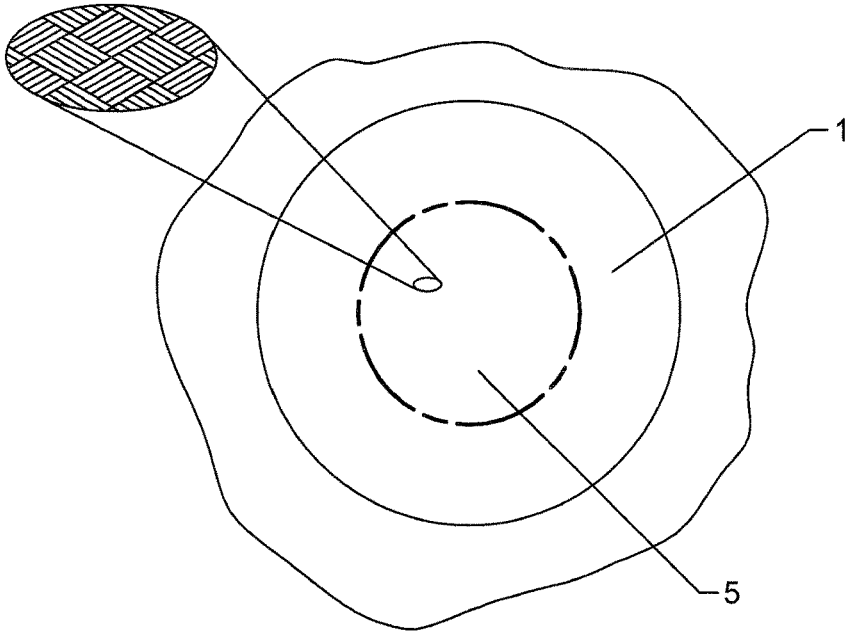
FIG. 52 contains a schematic view from above of the embodiment shown in FIG. 50.

FIG. 52 contains a schematic view from above on the surface 2, which in fact is covered by the layer of hard material 3 (not shown in FIG. 52), and the raised embossing element 1 of the embodiment of FIG. 50, wherein the platform 5 has a circular shape.

Figure 53:
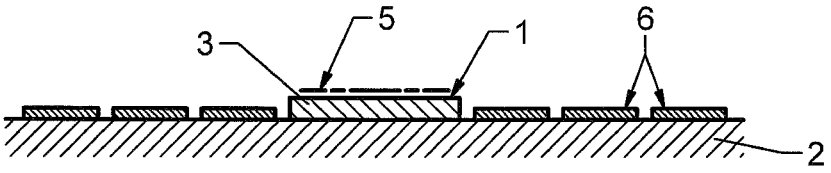
FIG. 53 illustrates a further example embodiment for the raised embossing element according to the invention.

FIG. 53 illustrates a further example embodiment for the raised embossing element 1, whereby the raised embossing element 1 is built on a protuberance of the hard material 3, similar as the embodiment shown in FIG. 51. Similar as in FIGS. 50 and 51, the platform 5 comprises micro-structures (not shown in the figures). In FIG. 53 the surrounding surface of the embossing element that is adjacent to the raised embossing element 1, carries a plurality of macro-structures 6. In the example of FIG. 53, the macrostructures are made from ta-C but other materials can easily be substituted to obtain similar macrostructures.

Figure 54:
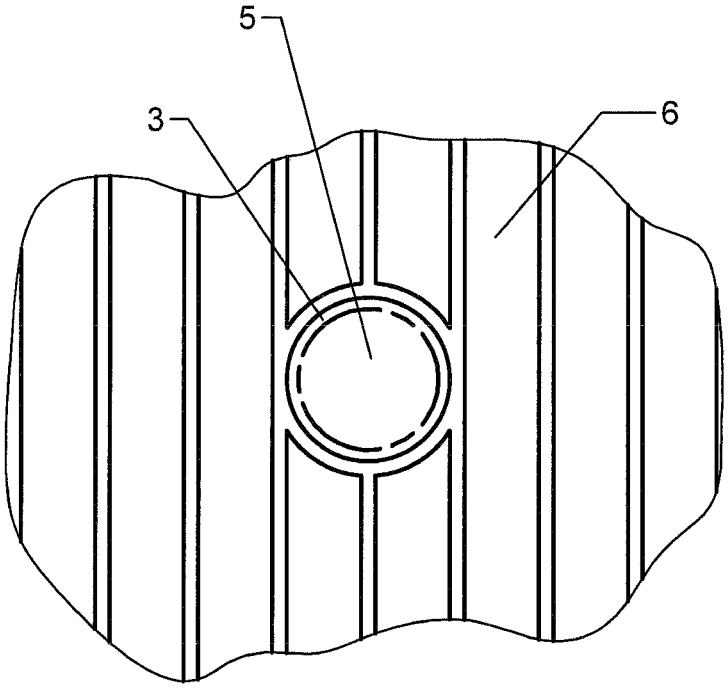
FIG. 54 contains a schematic view from above of a raised embossing element surrounded by macrostructures.

FIG. 54 contains a schematic view from above on the surface 2 (not referenced in FIG. 54) covered by macro-structures 6 (the individual macrostructures are not visible in FIG. 54). As an example the platform 5 is circularly shaped, similar as in FIG. 52, however different shapes are possible for the platform 5 without departing from the invention.

Figure 55:
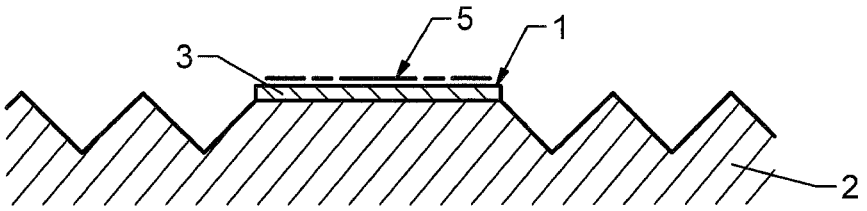
FIG. 55 illustrates a further example embodiment for the raised embossing element according to the invention.

FIG. 55 illustrates a further example embodiment for the raised embossing element 1 made out of hard material 3 on the surface 2. The surface 2 is shaped to form macrostructures on the surrounding surface adjacent to the raised embossing element 1. As in the previous embodiments, the micro-structures (not shown in the figure) are located on the platform 5.

Figure 56:
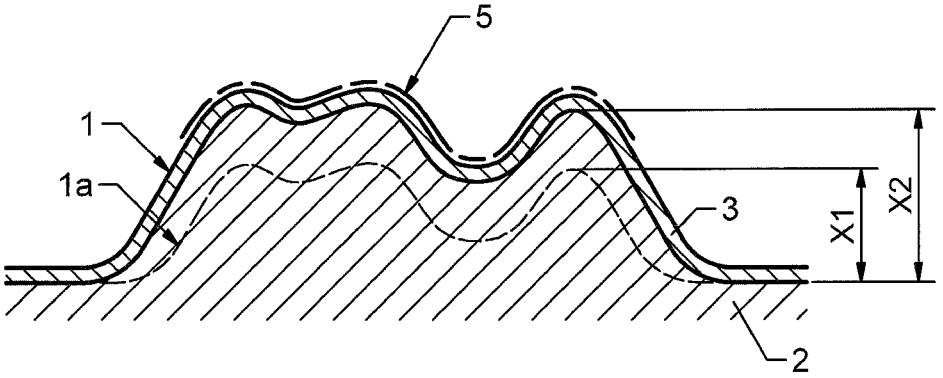
FIG. 56 illustrates a further example embodiment for the raised embossing element according to the invention.

FIG. 56 illustrates a further example for the raised embossing element 1, where—in this is obtained by deposition of the hard material 3 on a seemingly randomly structured surface 2 of the embossing roller. The platform 5 is formed by parts of the surface 3 sufficiently distant from a ground surface of the embossing roller and is covered with micro-structures as appropriate. The stripe 1*a* represented in a dashed line corresponds to a profile as it were, if the structure had no additional hard coating and no microstructures, and therefore its working principle would be that of a pure macroscopic patrix/matrix roller system. To achieve the necessary local pressure for transfer of microstructures the real profile 1 is, in overlay with the profile 1*a* for pure patrix/matrix embossing, more prominent, for example locally more prominent by a height value ΔX corresponding to the difference ΔX=X2−X1. This feature corresponds to the raised embossing element 1 and platform 5 as described in reference to FIG. 50 for example in its properties for pure cylindrical rollers.

Figure 57:
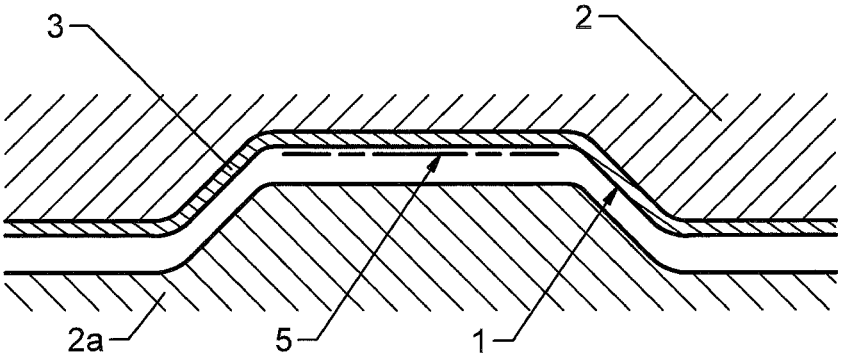
FIG. 57 shows an example of an inverted structure of that shown in FIG. 50.

FIG. 57 shows for the upper part, roller 2, an inverted structure to FIG. 50. The coating 3 is applied to the surface of the matrix roller and therefor has a concave profile. For this case, the microstructures are applied to the zone 5 inside of the matrix roller. In the transitional zone 1 between the non-profiled roller surface and the matrix structure, micro-structures can be applied on a case-to-case basis. The patrix roller for this roller stand is indicated by 2*a*. Using the right patrix, the transfer of microstructures is possible in the same fashion as if they were on the patrix itself. The only difference is, that the surface on the foil that is embossed with the microstructures has in this configuration to be oriented towards the matrix. In consequence the microstructures, and therefore the colors will, on the final product, be on the pronounced profile. A wider range of colored optical effects is therefor possible.

FIGS. 58*a*-58*c* illustrate possible embodiments for the embossing material and requirements for enabling embossing of micro-structures. In order to realize a color effect by means of the embossing, it is necessary to have a layer that can receive the micro-structures. According to diffraction laws, periodic micro-structures produce an optical color effect in reflection and/or transmission.

FIGS. 58*a* and 58*b* show variations of a material to be embossed, in which the underlying support material 8 is not optically transparent. On the surface there is a reflecting layer.

FIG. 58*a* shows an embodiment in which the reflecting layer is a metallic layer 9, e.g., aluminum.

FIG. 58*b* shows a further embodiment in which a reflection is achieved by a dielectric layering 10 of alternating diffraction indexes—this is the principle of a dielectric mirror. Accordingly the FIG. 58*b* represents incoming light 12, directly reflected part 13 of the light, and two of the possible orders of diffraction 14. The micro-structures are in both FIGS. 58*a* and 58*b* made of the respective reflecting layers 9 and 10.

FIG. 58*c* shows a support material 11 that is transparent to light in the visible spectrum. Accordingly, incoming light 15 arrives from a back-side of support material 11. The transmitted beam 16 exits from the side opposite to the backside. On the exit side, FIG. 58*c* also illustrates diffraction orders 17 that may occur in case the light passes through micro-structures that may be made on the surface on the exit side.

The following describes examples configuration of embossing rollers and roller stands.

FIG. 59*a* contains a schematic illustration of a roller stand 18 with two embossing rollers 19 and 20 for embossing. Both embossing rollers 19 and 20 are cylindrical on a macroscopic scale (scale >0.1) with exception of the raised areas—not shown in FIG. 59*a*.

FIG. 59*b* contains a different embodiment of the roller stand 18 with a roller system comprising three embossing rollers 21 and 22. The embossing rollers 21 and 22 are cylindrical on a macroscopic scale (scale >0.1) with exception of the raised areas—not shown in FIG. 59*b*. More particularly, the counter rollers 22 may be perfectly cylindrical, while the driving roller 21 carries raised areas representing logos.

FIG. 59*c* contains a schematic illustration of a roller stand 18 with two embossing rollers 19 and 23 (see also FIG. 60*b*). While one of the embossing rollers 19, is indicated as being cylindrical, the counter roller has a cambered geometry. In contrast to FIGS. 59*a* and *b* the rollers in this figure are shown in contact and are pressed to one another. Under very high embossing pressures the cylindrical roller 19 will bend and both rollers will provide a homogeneous embossing crack allowing for homogeneous pressure distribution.

FIGS. 60*a*-60*c* represent possible examples of configuring the embossing rollers. The embossing roller 19 that has a raised area for representing a logo is identical in all 3 figures.

FIG. 60*a* shows the two rollers 19 and 20 as cylindrical rollers. The counter roller 20 is a plain cylinder having no further structures. The logo in roller 19 is made from micro-structures 28 on a raised platform 27. After embossing the logo appears on the embossed sheet as shown by reference 29 in a magnified view.

FIG. 60*b* shows a possibility in which the counter roller 23 is cambered. In other words the roller 23 is still a rotational body, but its diameter varies. Such a cambered roller has shown to be very effective in the case if the required embossing pressure is so high that a bending of the embossing rollers cannot be neglected anymore.

FIG. 60*c* shows an example in which a roller 24 that carries a logo and a counter roller 25 both are configured to have synchronizing means, such as for example teeth 26. This is advantageously used in case in case the embossing rollers comprise other structure in addition of the logo that require a synchronized manner of working.

FIGS. 61*a* and 61*b* show two example embodiments that allow to emboss with the use of three embossing rollers.

FIG. 61*a* has on an embossing roller 30 a logo area that is surrounded by macroscopic structures 36, that may for example be distant from the logo by more than 100 μm and produce no color effects. These macroscopical structures cooperate with counter roller 33 according to the patrix/matrix principle. The counter roller 33 carries corresponding macroscopical structures 37 that cooperate with the macroscopic structures 36 on embossing roller 30 to obtain macroscopic embossing structures. These are shown in the magnified representation at the reference sign 38 next to the micro-structure 29. The micro-structure 29 may be realized using the counter roller 32.

U.S. Pat. No. 6,176,819 B1 which is incorporated herein by reference illustrates an other possible embodiment of a device for embossing that enables the embossing of macroscopic structures according to the pin-up/pin-up embossing method. The embossing process is effected between a pair of embossing rollers provided with tooting of the same kind which comprises rows of pyramidal teeth extending in the axial and the circumferential directions. The device described in U.S. Pat. No. 6,176,819 B1 may very well be used as example to derive an adapted configuration for macroscopic embossing in the present invention.

FIG. 61*b* shows an example in which the micro-structure is embossed with counter roller 34. The embodiments of these two rollers is shown in FIGS. 60*a*-60*c*. The logo carrying roller may also emboss micro-satinating structures by means of a second counter roller. Accordingly the rollers 31 and 35 have areas 39 and 40 with structures that produce satinating structures. If embossed on paper, then next to the microstructure 29 appears a satinized area 41.

In a preferred embodiment partially represented in the figures, the embossing results may be obtained from a configuration of rollers departing from that shown in FIGS. 61*a* and 61*b*, wherein there are only 2 rollers, namely rollers 30 and 33 for FIG. 61*a*, or rollers 31 and 35 for FIG. 61*b*. The configurations with 2 rollers would in effect correspond to a configuration as shown in FIG. 59*a*. The use of a second counter roller such as counter roller 32 for FIG. 61*a* and counter roller 34 for FIG. 61*b* is dependent on a surface profile on the driving rollers 30 and 31 respectively.

The present section describes examples of grating structures to be achieved through roller embossing of foils and inner liners surfaces, by making use of rollers with raised embossing elements that are obtained through processes as explained in the present description.

The grating structures to be achieved are to be used as reflective structures, and comprise ripple gratings, groove-land—see for example FIGS. 27-49—gratings, and blaze—i.e., saw teeth—gratings, all having sizes of structures ranging between 0.3 and 2.0 μm.

The gratings structure are used to create patterns, which are optical diffractive microstructures. The latter produce when illuminated by diffuse or directed light in the visible spectrum, diffraction images with high contrast and high brilliance if observed in a determined angle.

The Gratings

In the following the terms contrast, luminosity and perception of color are defined for the sake of clarity as to the meaning they have throughout the present description.

Contrast

Contrast is the difference in luminance and/or color that makes an object (or its representation in an image or display) distinguishable. In visual perception of the real world, contrast is determined by the difference in the color and brightness of the object and other objects within the same field of view. The maximum contrast of an image is the contrast ratio or dynamic range.

Luminosity

The luminosity function or luminous efficiency function describes the average spectral sensitivity of human visual perception of brightness. Brightness is an attribute of visual perception in which a source appears to be radiating or reflecting light. In other words, brightness is the perception elicited by the luminance of a visual target. This is a subjective attribute/property of an object being observed.

Hence the luminosity function or luminous efficiency is based on subjective judgments of which of a pair of different-colored lights is brighter, to describe relative sensitivity to light of different wavelengths. It should not be considered perfectly accurate in every case, but it is a very good representation of visual sensitivity of the human eye and it is valuable as a baseline for experimental purposes.

Perception of Color

Color vision or perception is the ability of an organism or machine to distinguish objects based on the wavelengths (or frequencies) of the light they reflect, emit, or transmit. Colors can be measured and quantified in various ways; indeed, a human's perception of colors is a subjective process whereby the brain responds to the stimuli that are produced when incoming light reacts with the several types of cone photoreceptors in the eye. In essence, different people see the same illuminated object or light source in different ways.

Noticeable optical effects can be obtained and enhanced according to the following facts:

in order to achieve a high brilliance the diffractive grating surfaces—also known as color surfaces—must be large enough to produce a high intensity of diffraction, while at the same time neighboring surfaces will produce a high contrast by either providing a lower intensity of diffraction or diffracting in a direction different that may not be perceived by the observing user—neighboring surfaces appear to be darker—or absorb incoming light, or scattering it in a diffuse manner. This may for example be achieved by giving different orientations from each grating relative to an azimutal observation direction;

the brilliance of individual colors, e.g., of red, in one direction of observation or in a plurality of determined or random observation directions may be increased by appropriately choosing the grating's period and the grating's shape—for example a line grating as a groove-land grating for one observation direction and a pillar gratings with multi cornered pillar cross-section for a plurality of determined directions of observation and a pillar grating with a circular cross-section for any direction of observation—and by an appropriate choice of the grating structure's depth;

since blaze-gratings produce a much higher intensity of diffraction then for example groove-land gratings, it is possible to obtain a strong difference in contrast to neighboring surfaces and a strong brilliance, if the areas with strong brilliance are realized as blaze-gratings and the neighboring areas as groove-land or pillar gratings;

since the human eye has a color sensitivity that depends on the wavelength and therefore perceives with different intensities the various colors at a same diffraction intensity (brilliance), the brilliance may possibly be improved by producing appropriated mixes of colors with diffraction gratings.

The patterns to be embossed in the foils and inner liners comprise various gratings with a variety of different geometries. In the following we will review a number of preferred embodiments of patterns and/or gratings that constitute the patterns. It is to be noted that the optical resolution of the human eye is approximately 200 μm. However, in case the colors that occur from the diffraction at the reflective gratings are perceived as very brilliant, it has been found that the limit of optical resolution may be raised in the range of 70 μm to 100 μm.

An approximately square or rectangle surface with sides measuring in a range between 70 μm and 100 μm or an approximately circular or oval shaped surface having a diameter in the same range is the minimal size of surface to produce spectral or mixed colors with diffraction gratings.

In order to make these colors have a subjectively perceived brilliance of sufficient intensity, the surface observed by the user should be chosen to be much larger than the minimal size, for example by juxtaposing a plurality of such color pixels—a color pixel is a surface having the minimal size—that diffract the colors in the same direction of observation, or in the same plurality of directions of observation depending on the case.

The size of the surface to be observed should be in the range of at least one square millimeter up to one square centimeter in order to achieve a good, subjectively perceived brilliance. It is important for the brilliance subjectively perceived by the user to adjust the contrast in comparison to surrounding surface and to the size of the latter in proportion to the surface to be observed.

An embossed logo that needs to be perceived as brilliant should preferably be surrounded by areas of surface that diffract or scatter with a lesser intensity or in a different direction, or if a ta-C layer is used do not diffract at all. The surrounding areas of surface should thereby surround the surface to be observed, forming stripes and the proportion of surfaces to be observed vs surrounding areas of surface should be in the range of 1 to 3.

The indicated sizes of surfaces and proportion of surfaces have been determined under empirical measurements.

Possible basic geometries for diffractive gratings that may be produced through the mask projection technique—as explained in a section herein above—are listed here under:

parallel groove structures oriented in the same direction;
interrupted parallel groove structures;
a plurality of parallel groove structures that are rotated from one to an other in a determined angle;
parallel groove structures that are superposed under various angles—obtained through double structuring by 2 fold mask projection;
square pillar groove structures or intersecting groove structures;
ring shaped groove structures;
cylindrical pillars or cavities;
pillars or cavities with hexagonal cross-sections;
pillars or cavities with triangular cross-sections;
pillars or cavities with parallelogram shaped cross-section.

It is also possible in the mask projection technique to use basic geometrical shapes as apertures, the latter being used in the mask projection technique to produce various shapes of surfaces as basic surface areas and may be positioned next to one another to make images. Such basic geometrical shapes include: square;

rectangle;
triangle;
parallelogram;
hexagone;
circle and triangular pad;
circle and rectangular pad—astroid;
ellipse and rectangular pad—astroid;
circle and ellipse and pad—for a flower.

A number of the named geometries are illustrated in the figures.

First we will address aperture geometries.

FIGS. 1(1) to 1(10) illustrate examples of basic geometrical shapes. These shapes are produced preferably with an aperture positioned in proximity of the homogeneous spot in the laserbeam's optical path. The shapes are in order as follows:

(1) square;
(2) rectangle;
(3) triangle;
(4) parallelogram;
(5) hexagon;
(6) octagon;
(7) circle;
(7*b*) square pillow shape;
(7*c*) triangle pillow shape. It is required to have the aperture geometry of (7*b*), when the surface that is delimited by 4 circle shaped basic areas having the shape (7*a*), must also be structured (see also FIG. 21(2)). The aperture geometry (7*c*) is required, when the surface that is delimited by 3 triangle shaped basic areas having the shape
(7*a*), must be structured (see also FIG. 21(1));
(8*a*) ellipse;
(8*b*) square pillow shape;
(8*c*) triangle pillow shape. The aperture geometry (8*b*) is required in case the surface that is delimited by 4 ellipse shaped basic areas
(8*a*) is to be structured (see FIG. 21*a*(2)). The aperture geometry (c) is required in case the surface that is delimited by 3 ellipse shaped basic areas (8*a*) is to be structured (see FIG. 21*a*(1));
(9) six-branched star;
(10) eight-branched star.

Figure 2:
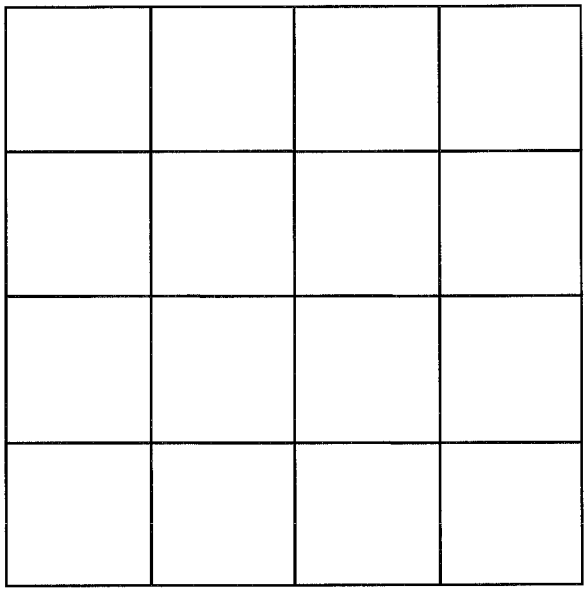
FIGS. 2 to 9 illustrate shapes that can be obtained by making use of one or a plurality of the same basic geometrical shapes.
Figure 2:
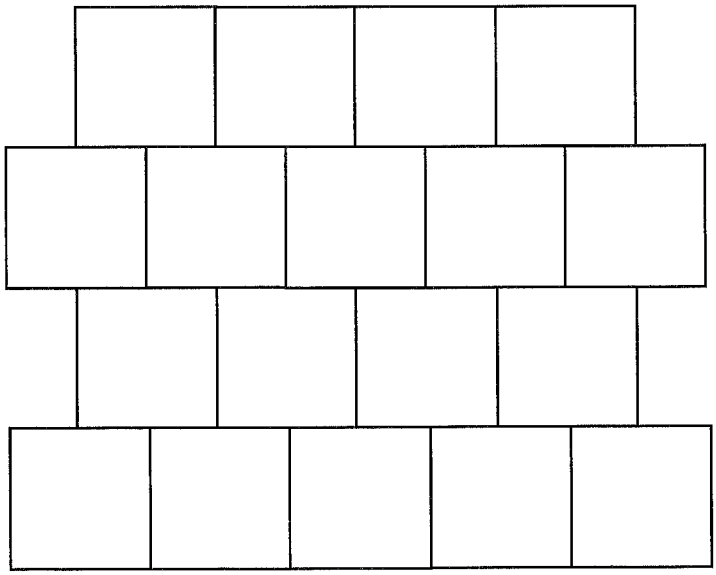

The following FIGS. 2 to 9 are shapes that can be obtained in addition by adjacently positioning, i.e., without any distance separating ground shapes, making use of similar aperture geometries for forming the section of the laser beam without separating spaces. FIGS. 2(1) and 2(2) illustrate examples of square-shapes made by positioning basic geometrical shapes of squares next to one another.

Figure 3:
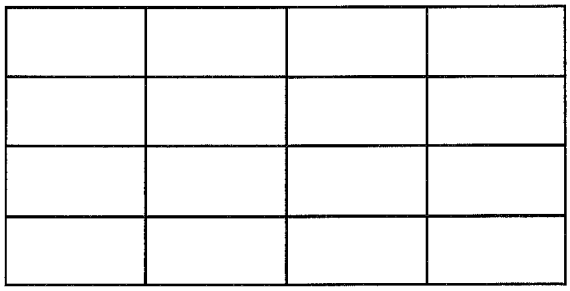
Figure 3:
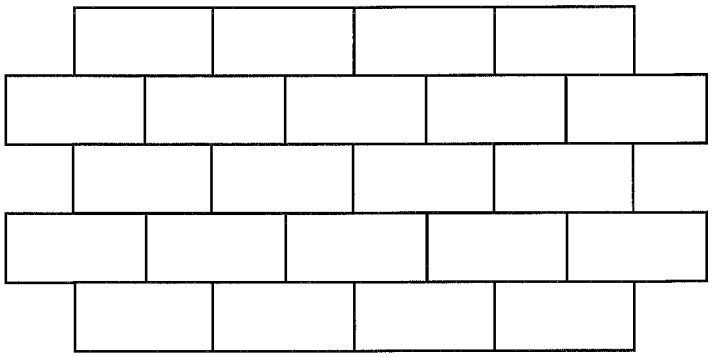
Figure 3:
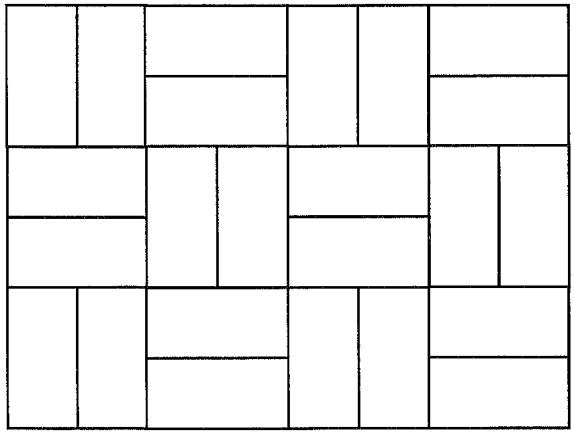
Figure 4:
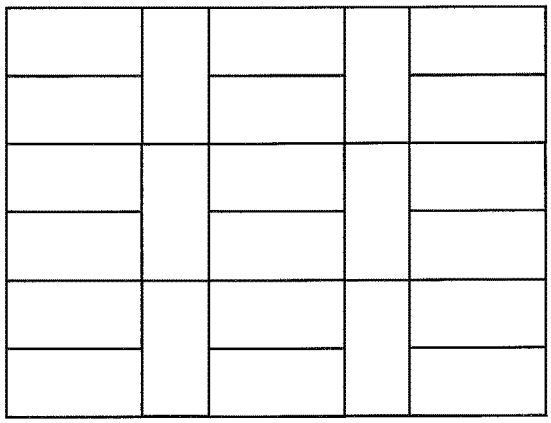
Figure 4:
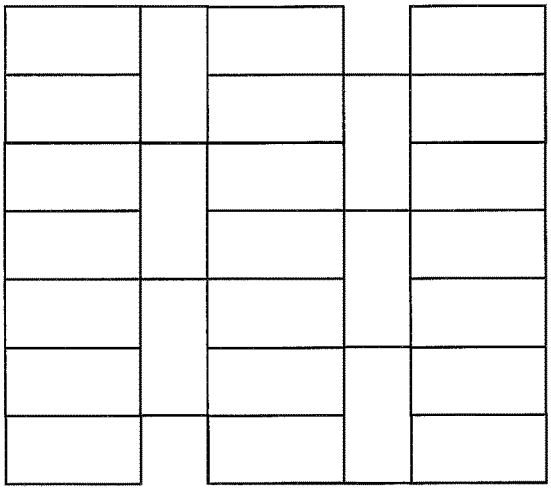
Figure 4:
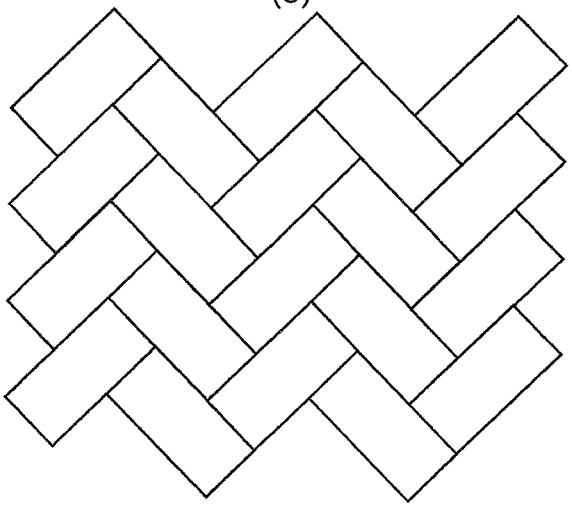

FIGS. 3(1) to 3(3) and FIGS. 4(1) to 4(3) illustrate examples of rectangle-shapes made by positioning basic geometrical shapes of rectangles next to one another.

Figure 5:
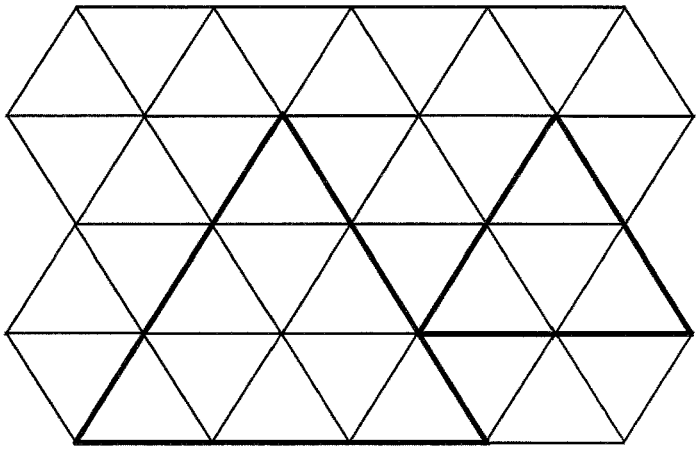
Figure 5:
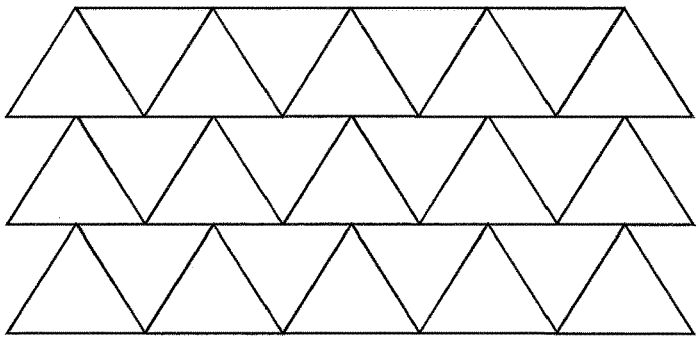
Figure 5:
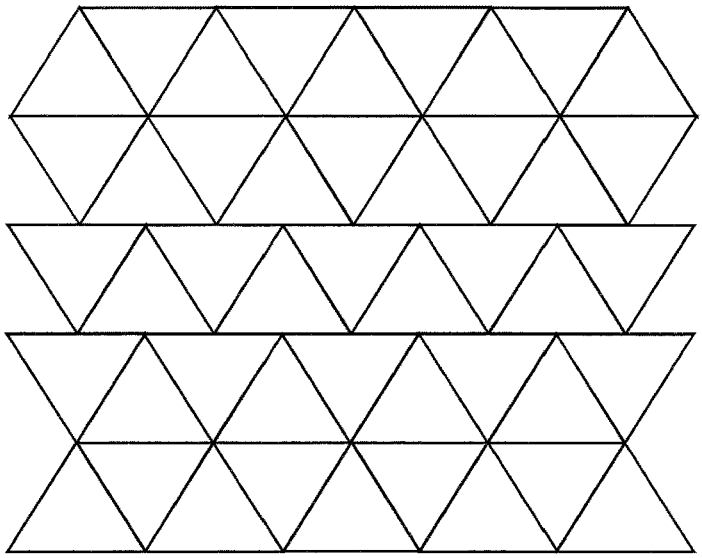

FIGS. 5(1) to 5(3) illustrate examples of triangle-shapes made by positioning basic geometrical shapes of triangles next to one another.

Figure 6:
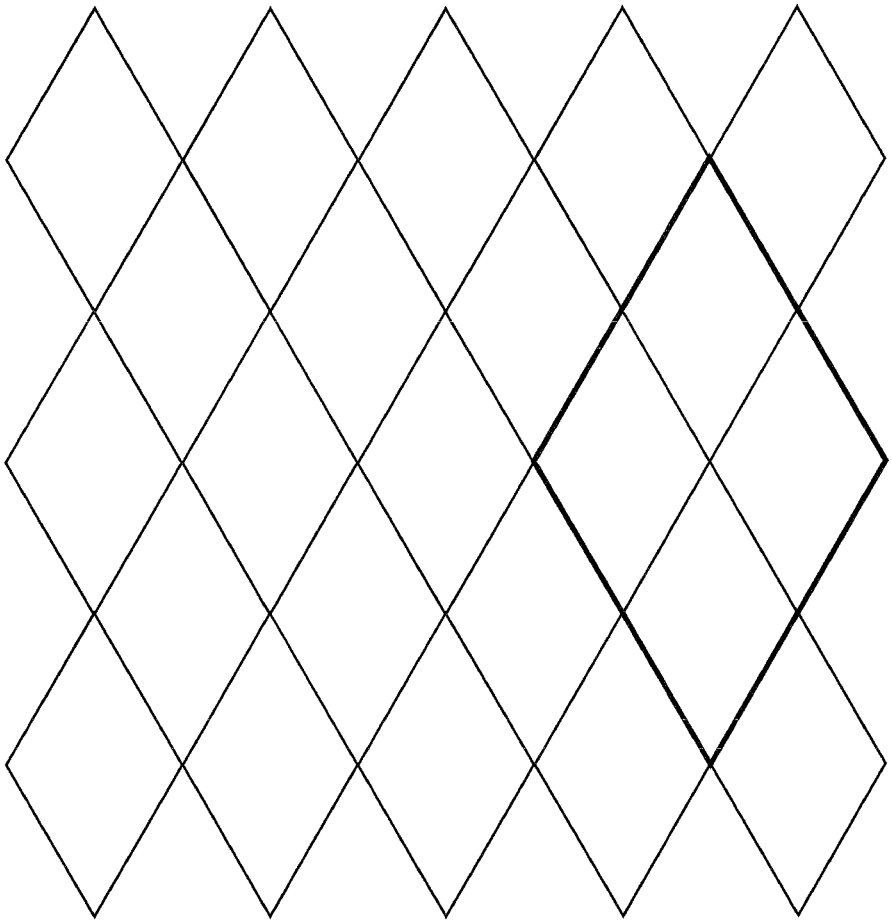
Figure 7:
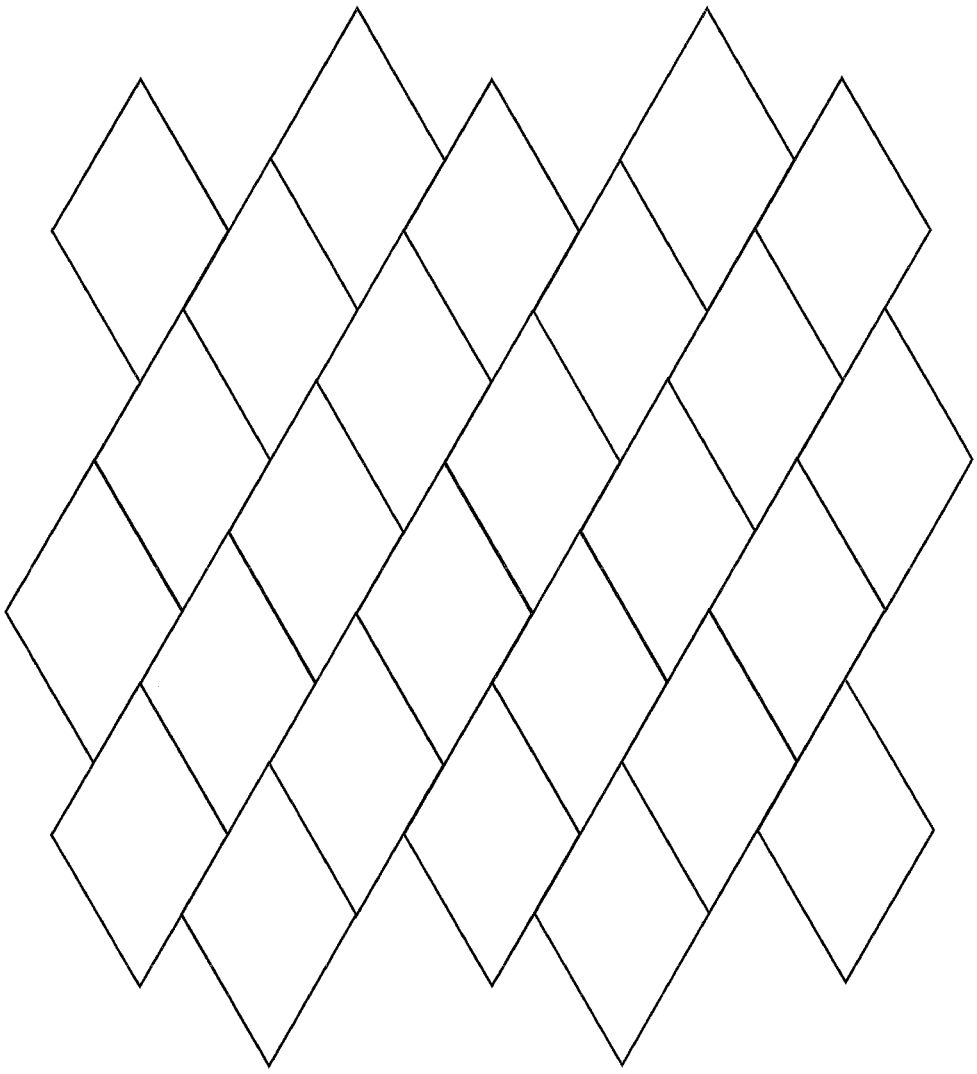

FIG. 6 and FIG. 7 illustrate examples of parallelogram-shapes made by positioning basic geometrical shapes of parallelograms next to one another.

Figure 8:
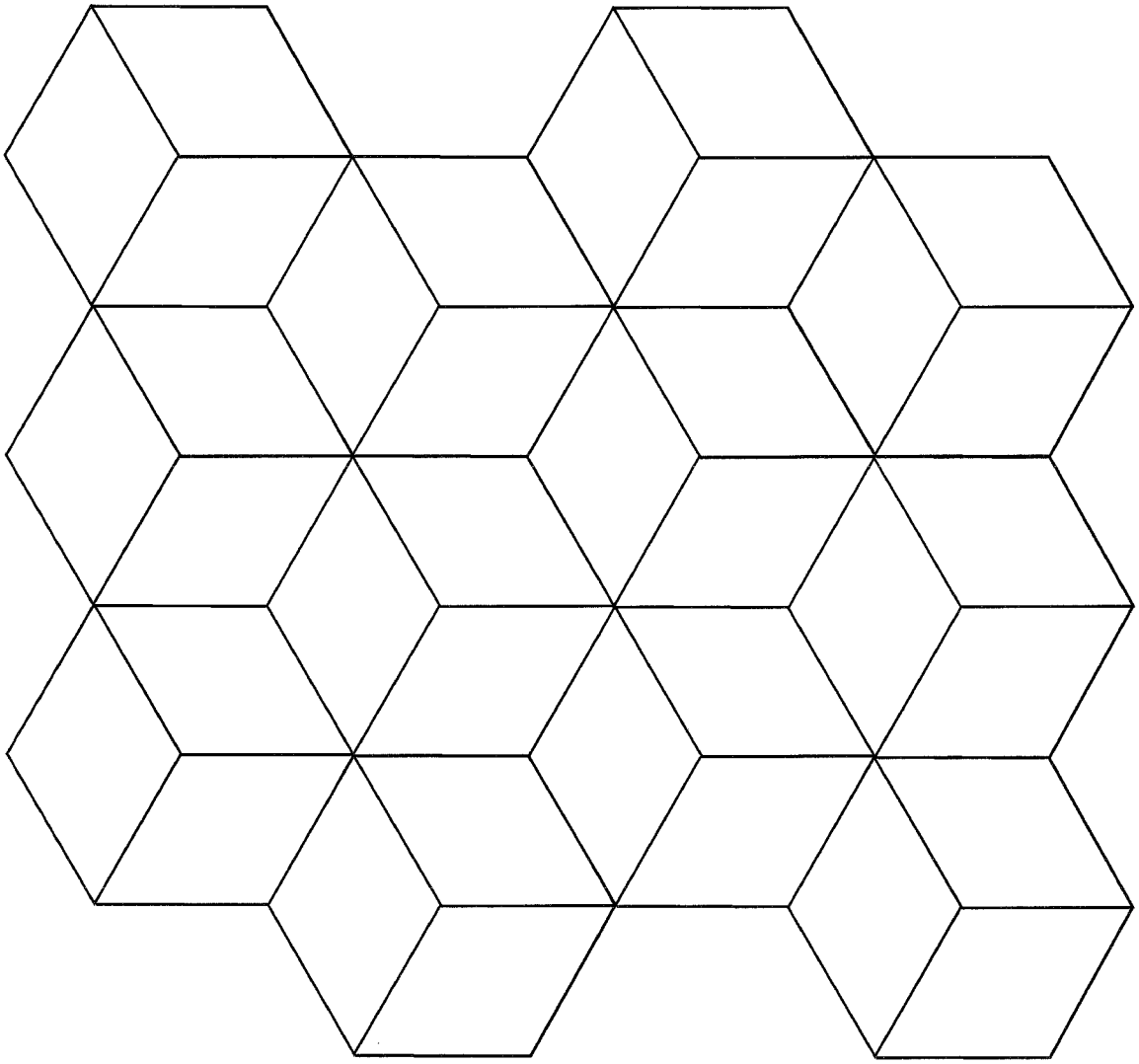
Figure 10:
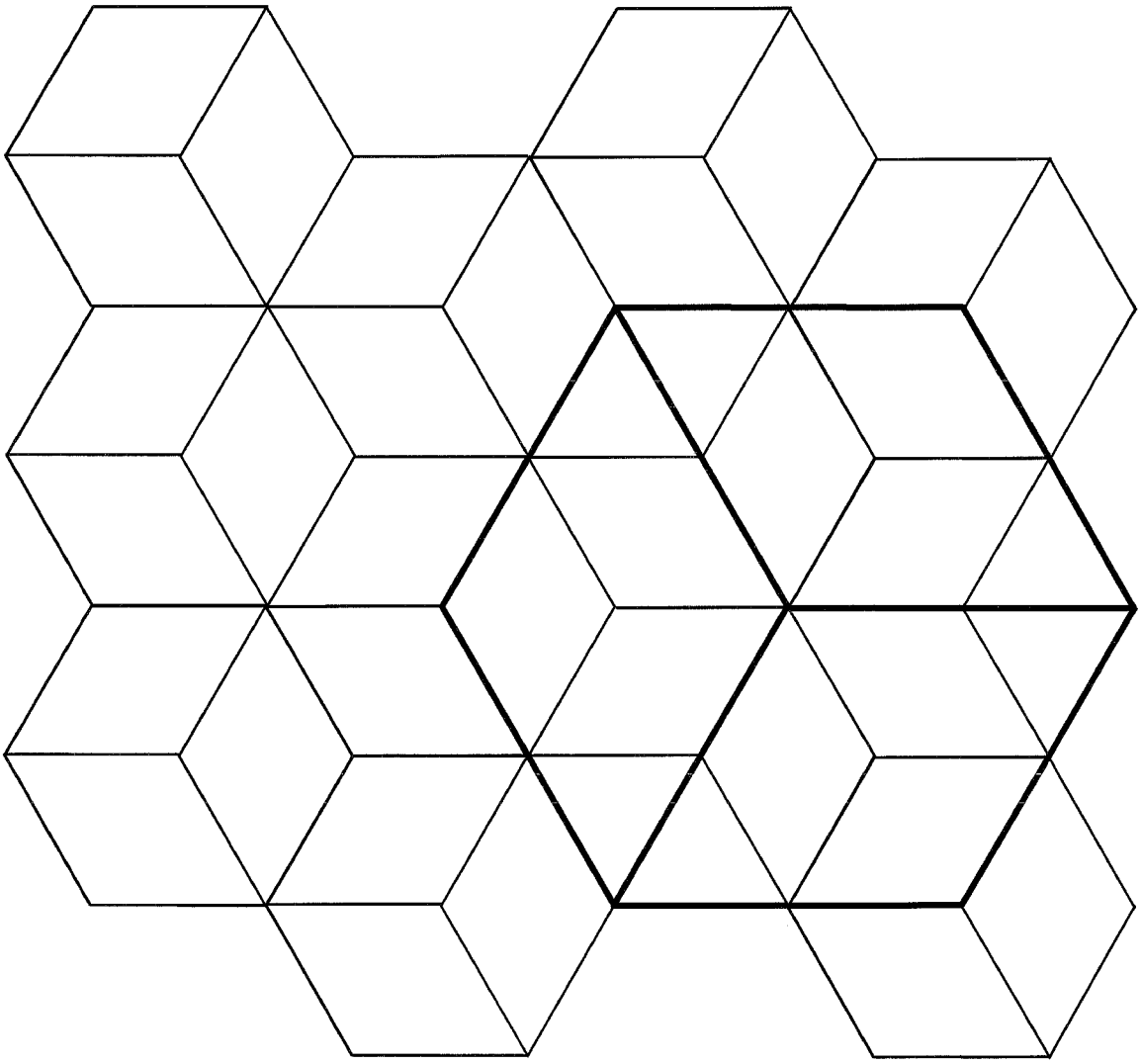
FIGS. 10 to 26 illustrate shapes that can be obtained through the use of basic geometrical shapes that are put together.

FIG. 8 and FIG. 10 illustrate examples of cube-parallelogram-shapes made by positioning basic geometrical shapes of variably orientated parallelograms next to one another.

Figure 9:
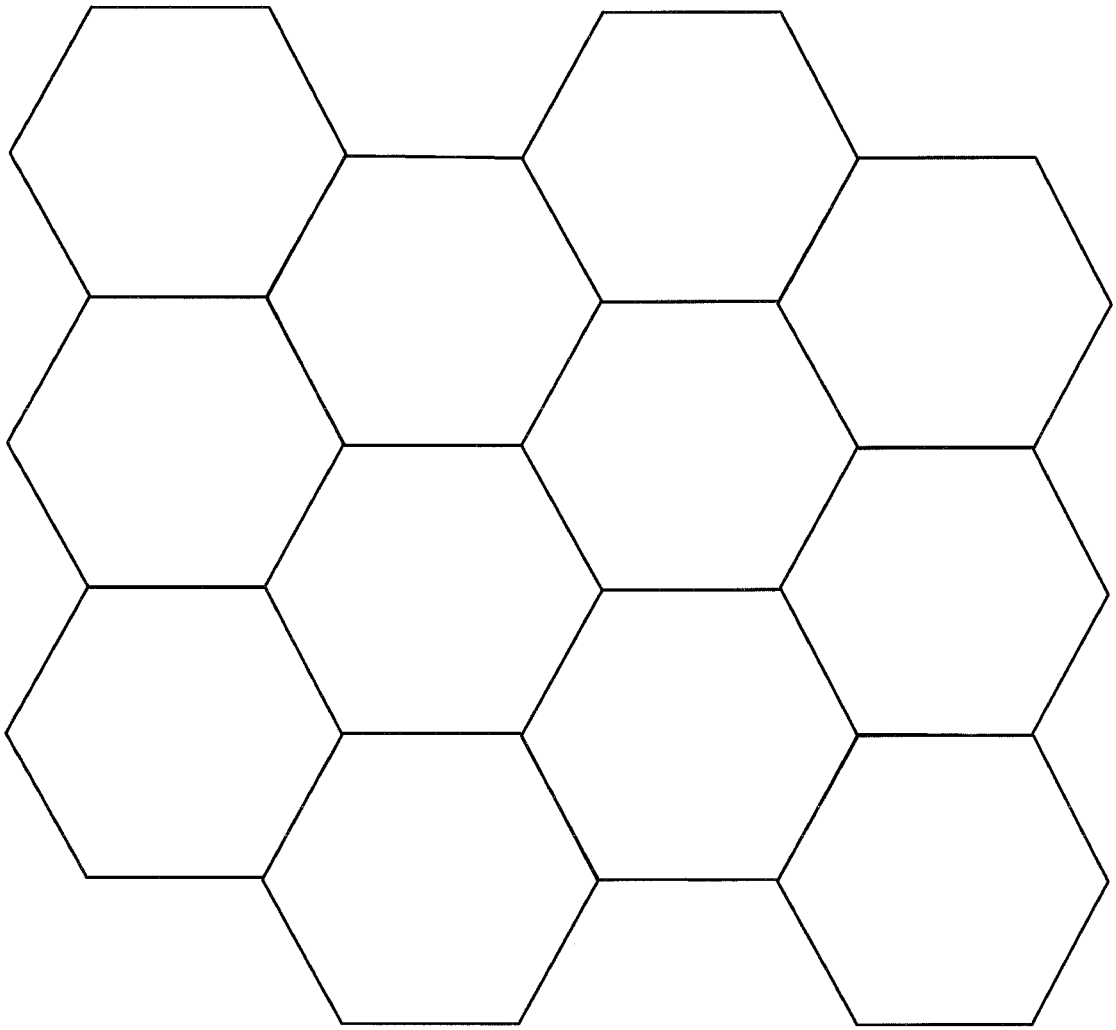

FIG. 9 illustrates an example of hexagon-shapes made by positioning basic geometrical shapes of hexagons next to one another.

The following shapes in FIGS. 10 to 26 are obtained through the use of apertures from FIG. 1, that are put together without separating spaces.

Figure 11:
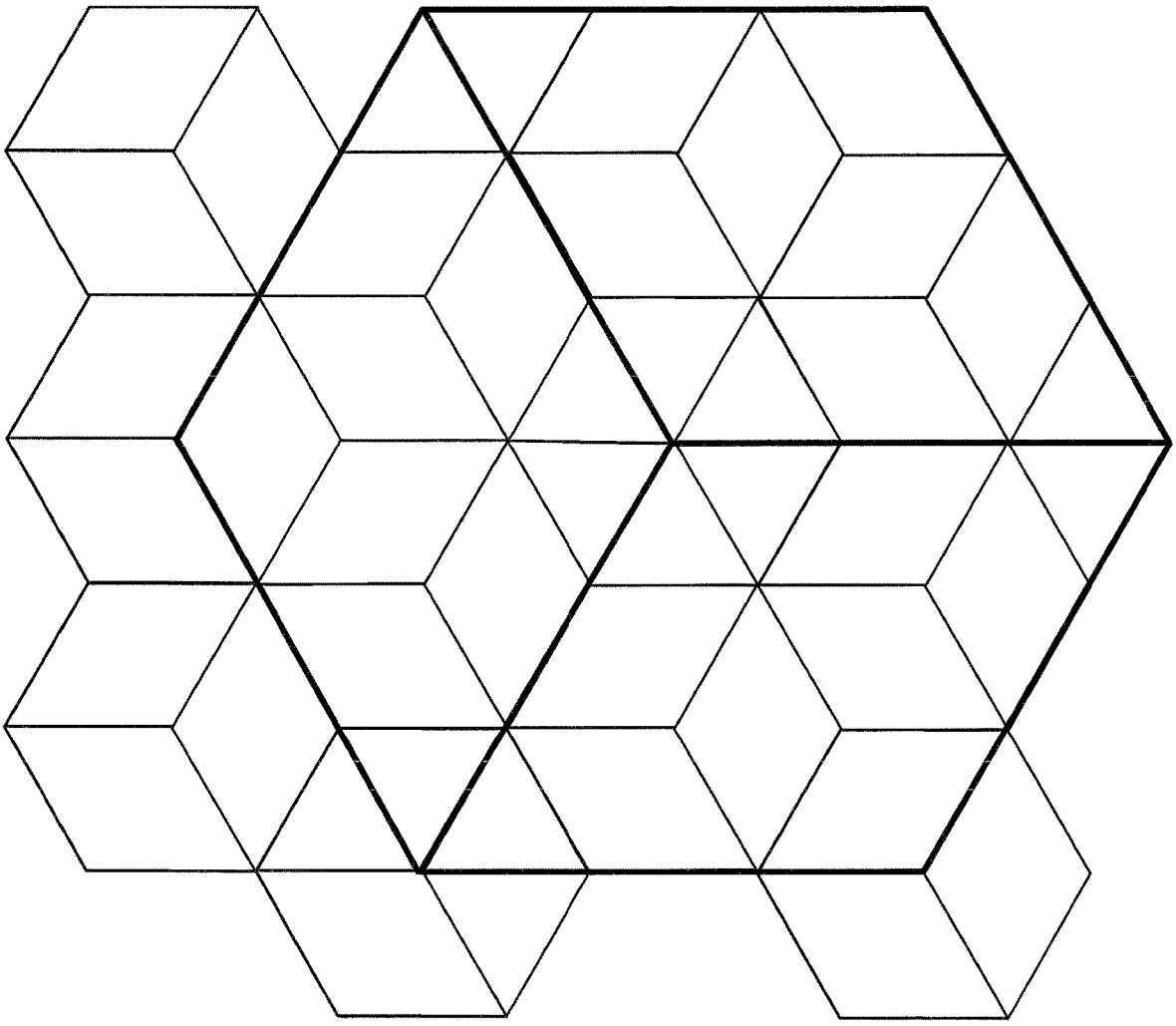

FIG. 10 and FIG. 11 illustrate examples of parallelogram-triangle shapes positioned to obtain larger cubes as illustrated by the bold lines.

Figure 12:
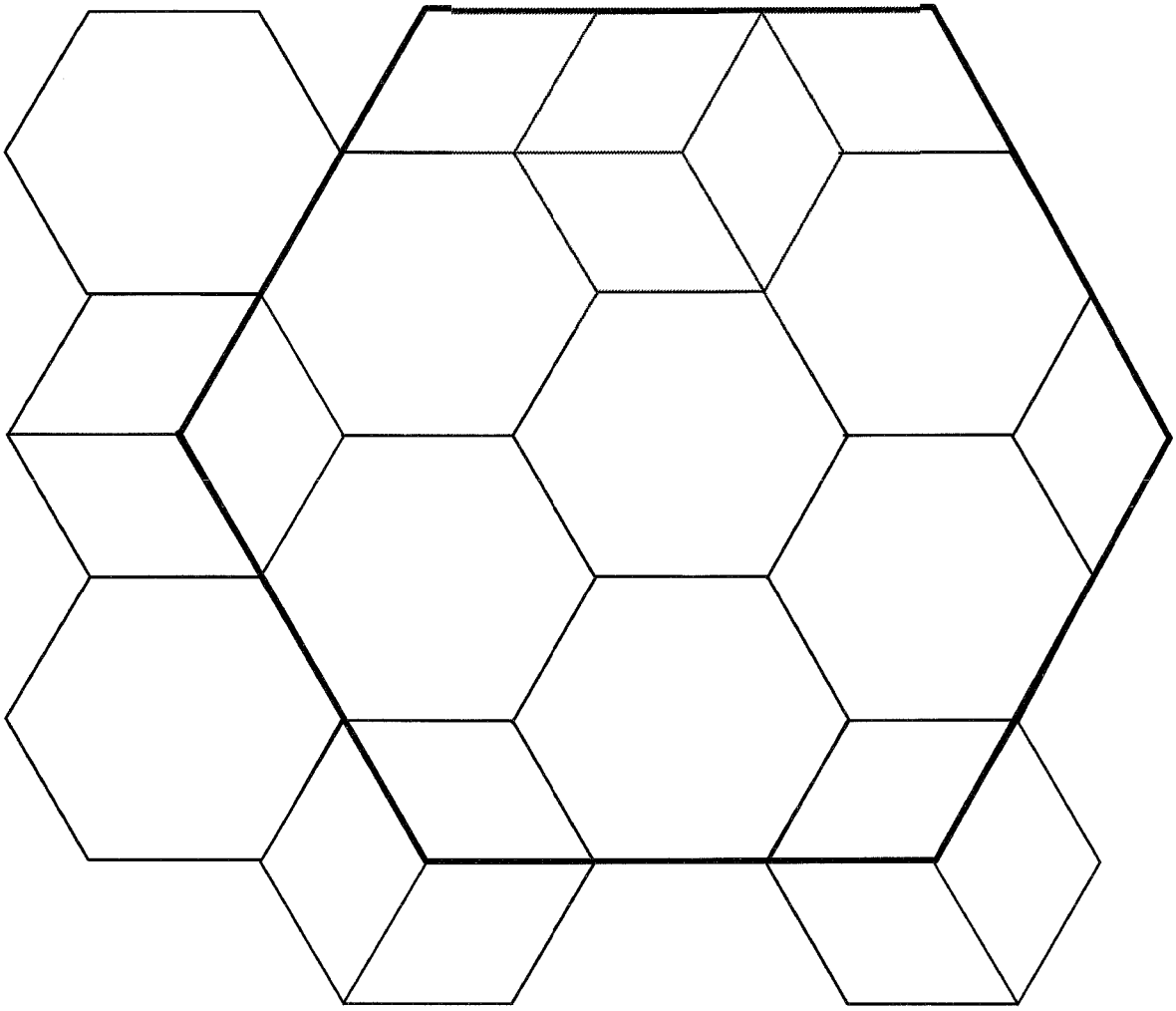
Figure 13:
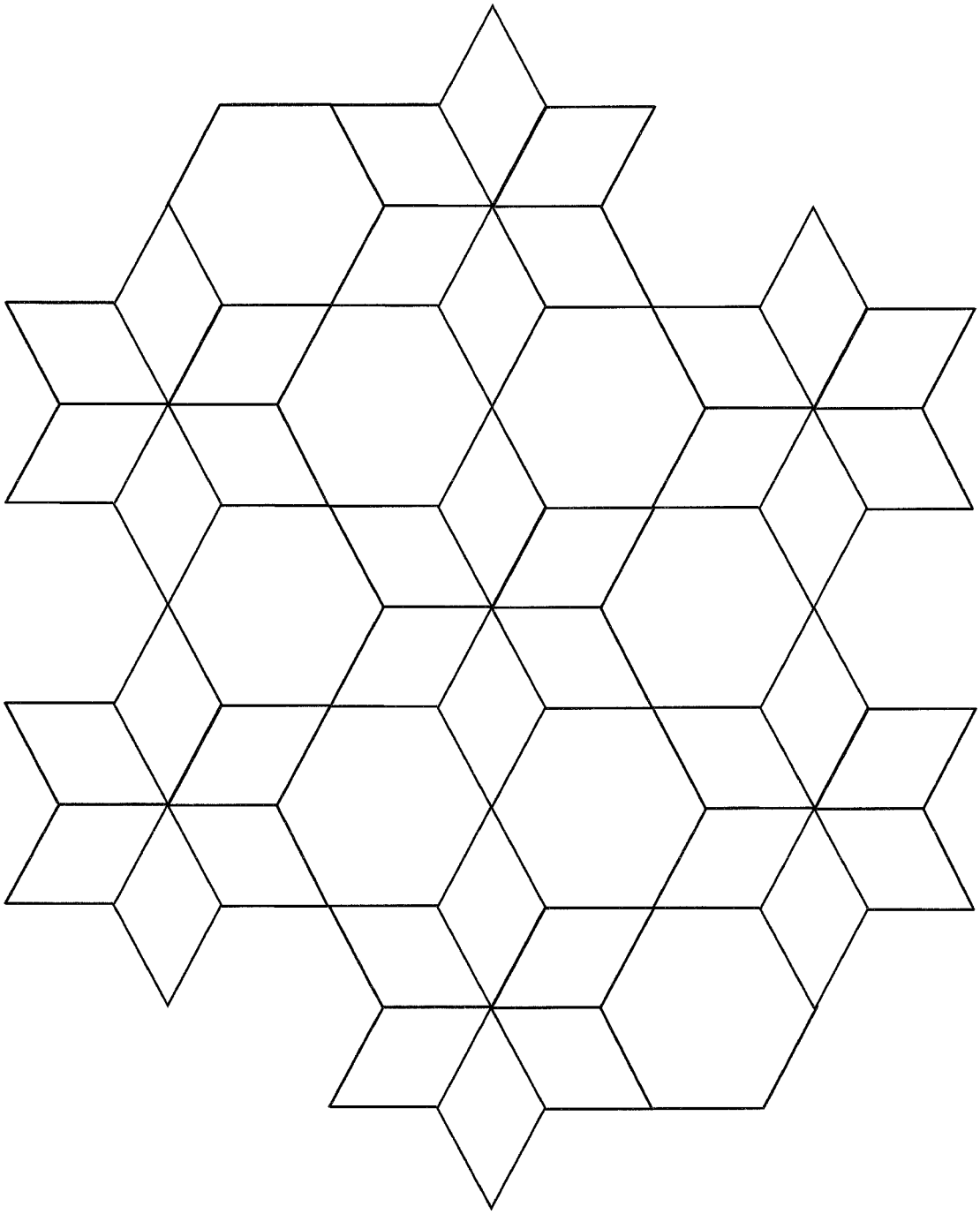
Figure 14:
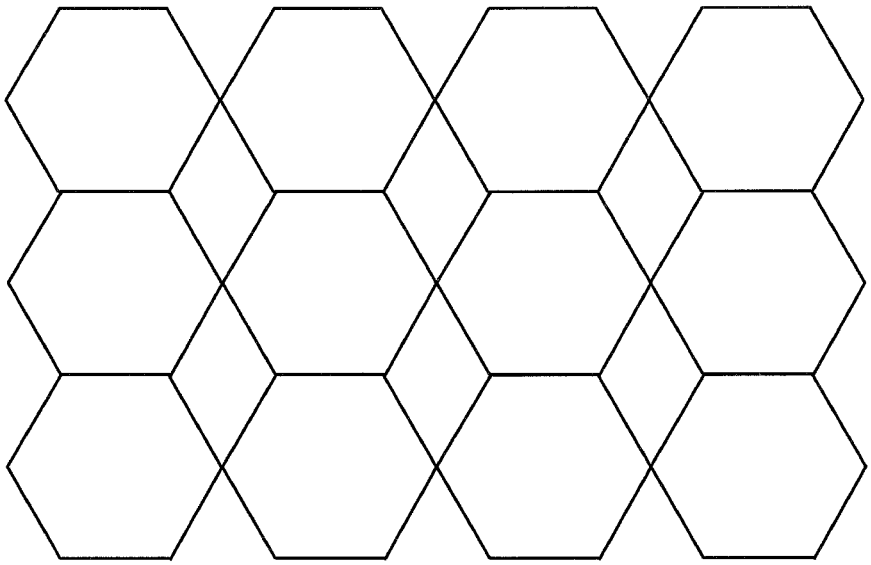
Figure 14:
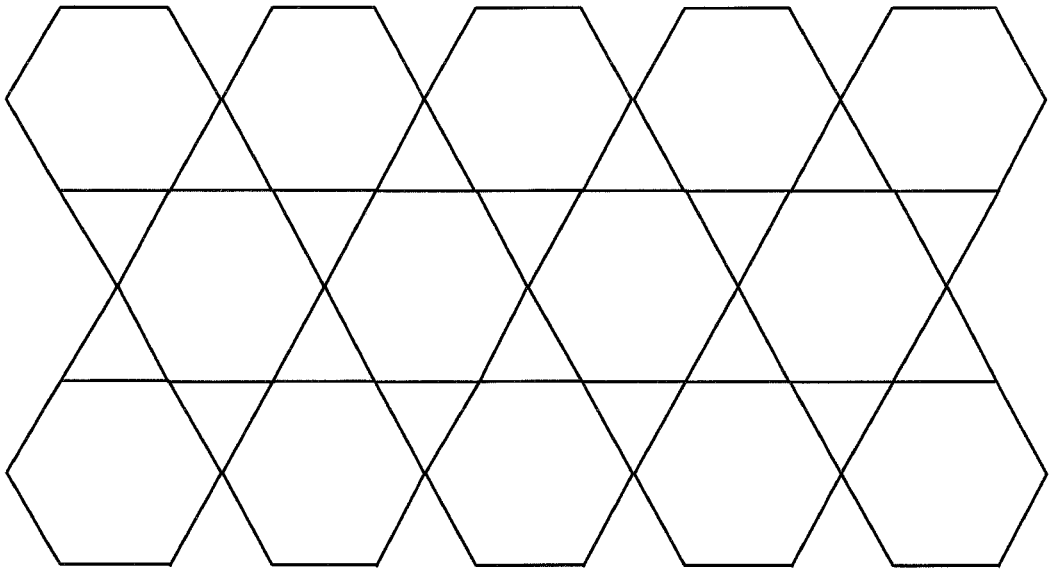

FIGS. 12, 13 and 14(1) illustrate examples of parallel hexagon shapes positioned to obtain larger hexagon surfaces as illustrated by the bold lines.

FIG. 14(2) illustrate an example of hexagon-triangle-shapes made by positioning basic geometrical shapes of hexagons and triangles next to one another.

Figure 15:
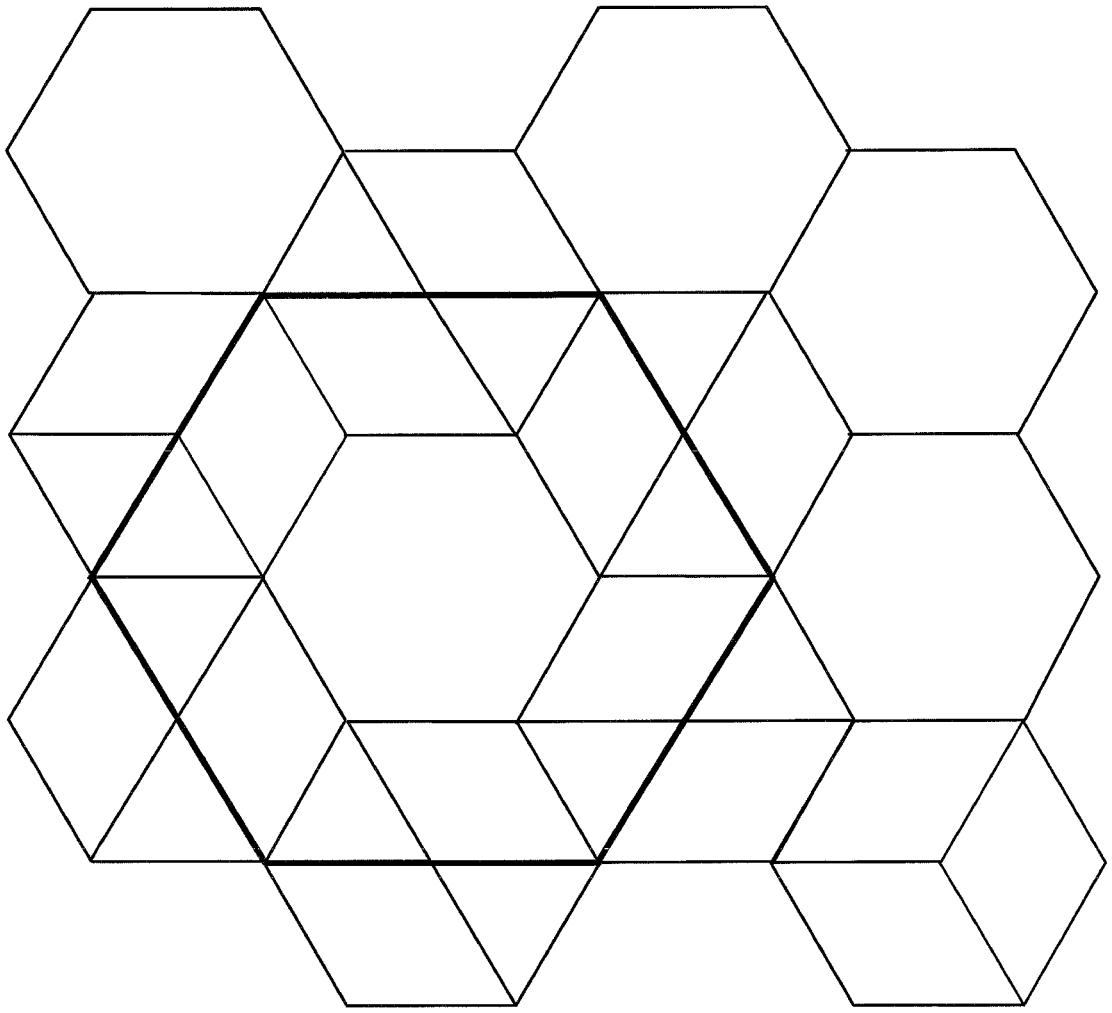

FIG. 15 illustrates an example of hexagon-parallelogram-triangle-shapes to obtain hexagon-cube patterns or larger hexagon-surfaces as illustrated by the lines in bold type.

Figure 16:
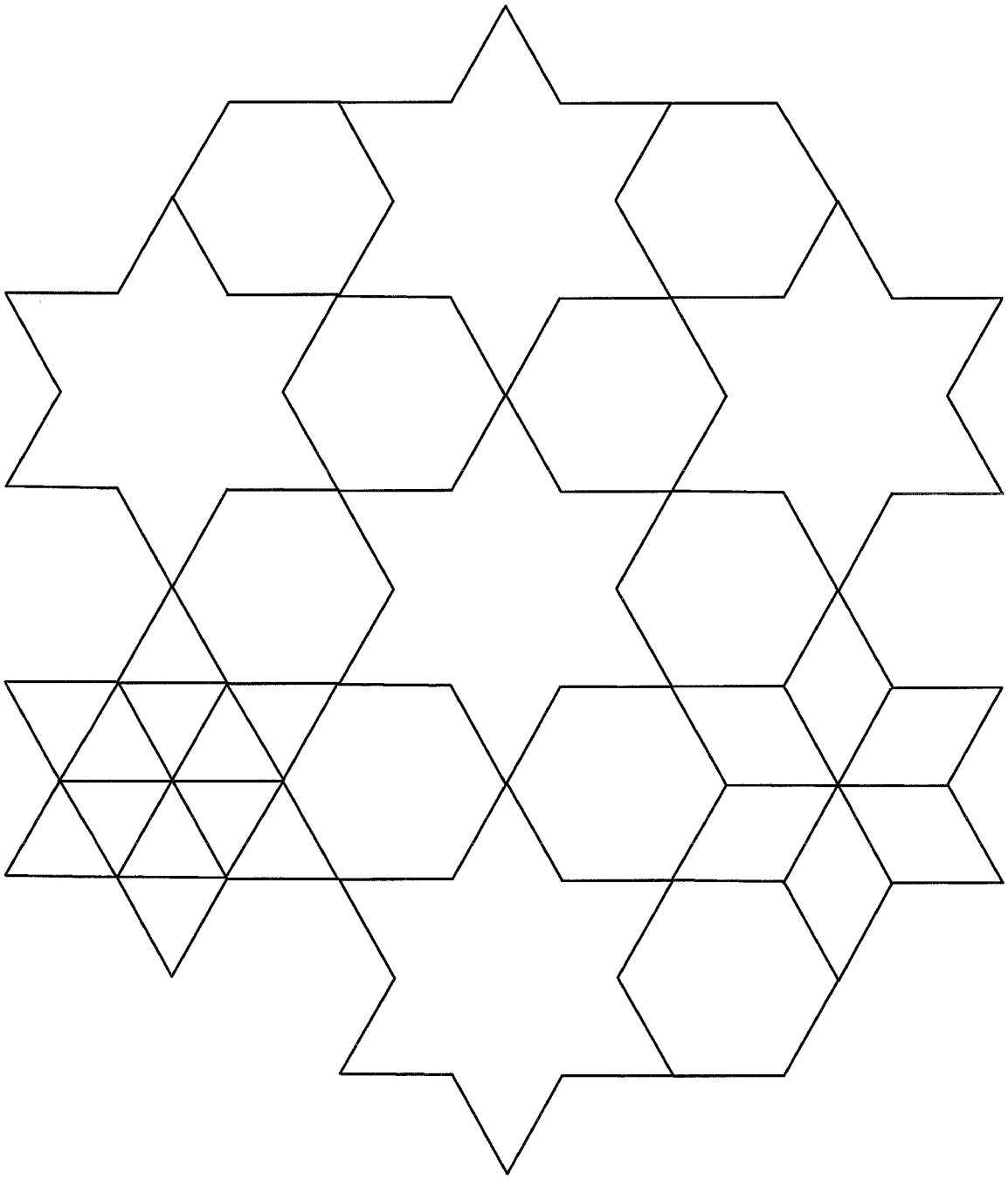

FIG. 16 illustrates an example of six-branch-star-hexagon-shapes made by positioning basic geometrical shapes of six-branch stars and hexagons next to one another.

Figure 17:
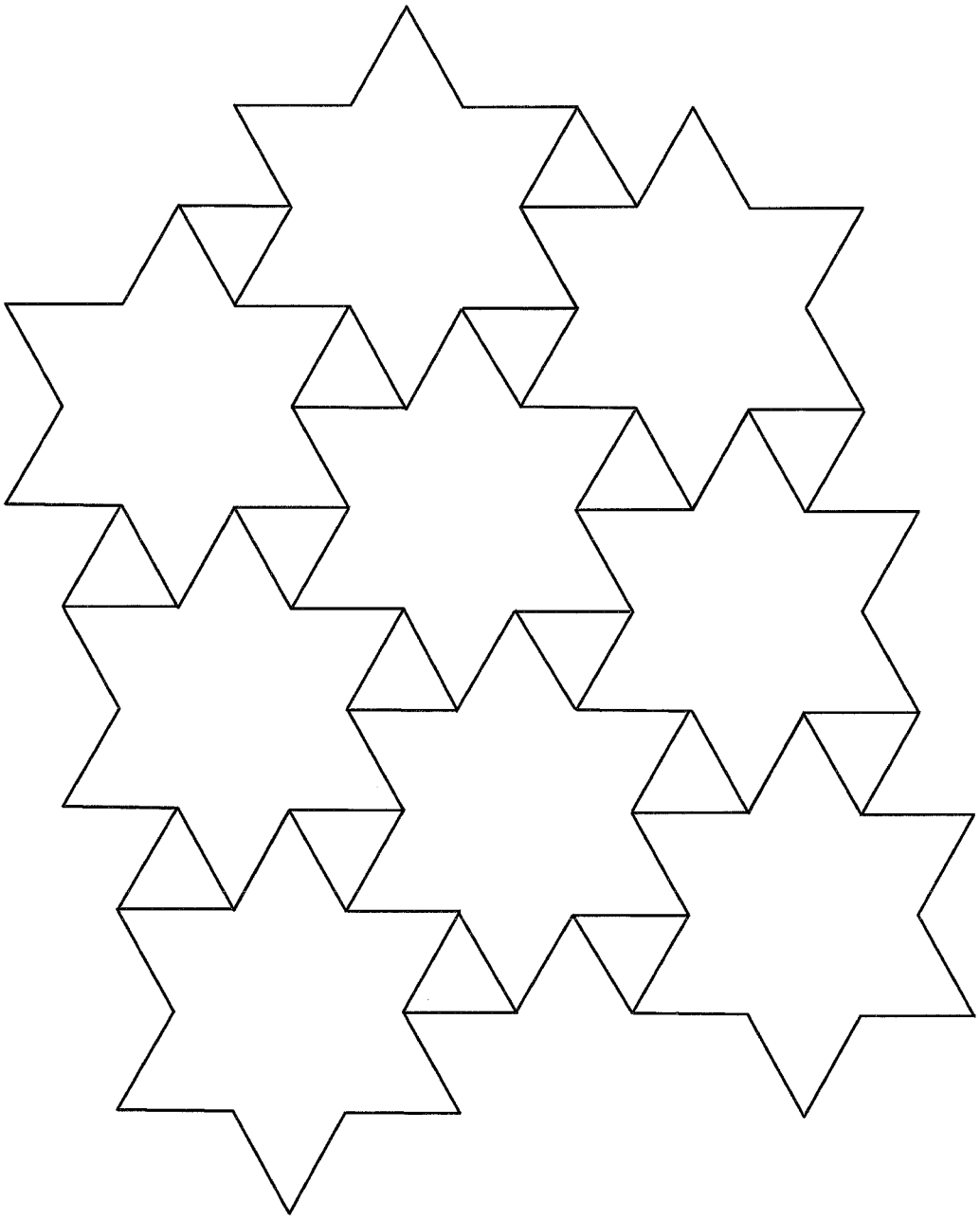

FIG. 17 illustrates an example of six-branch-star-triangle-shapes made by positioning basic geometrical shapes of six-branch-stars and triangles next to one another.

Figure 18:
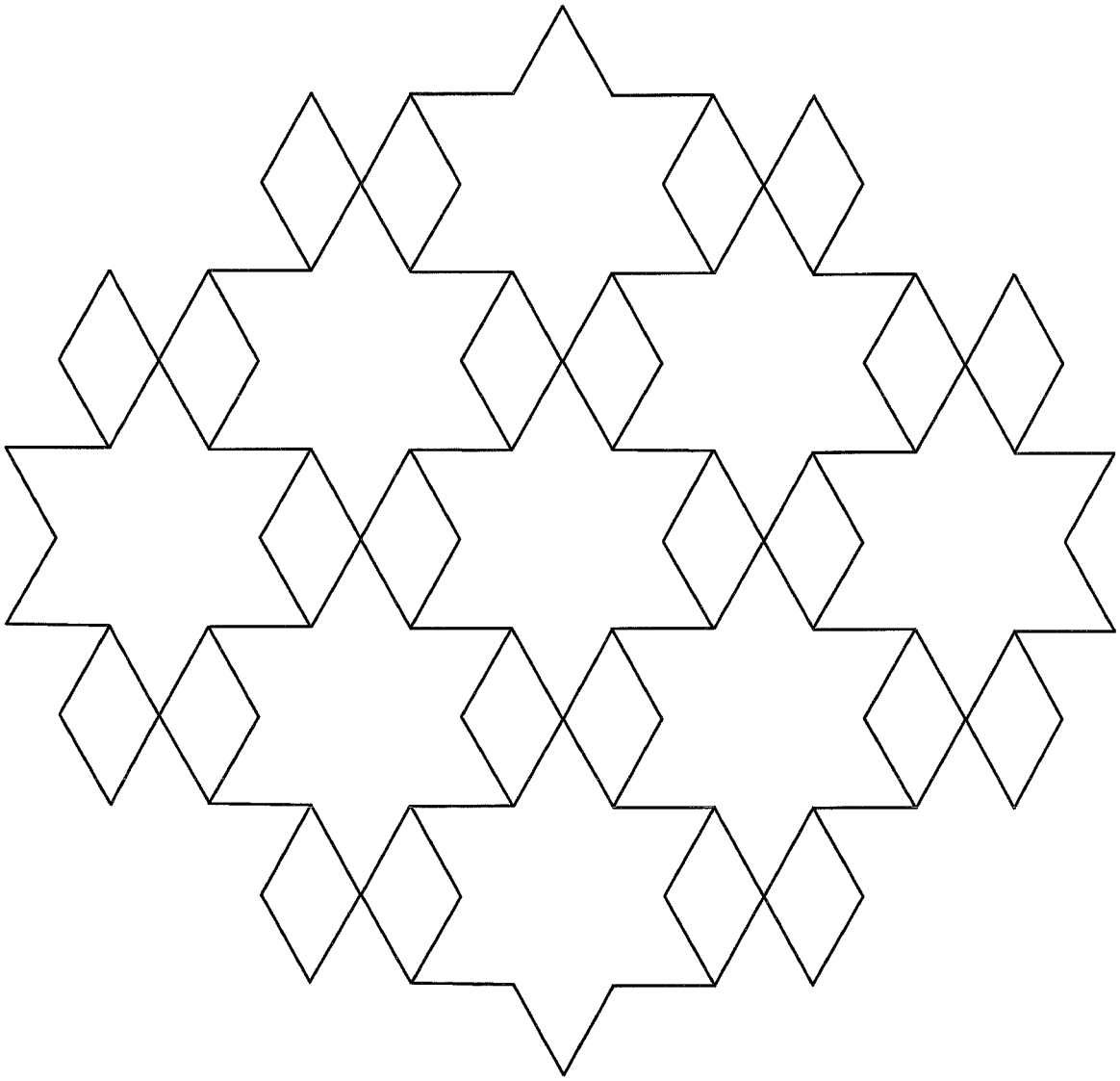
Figure 19:
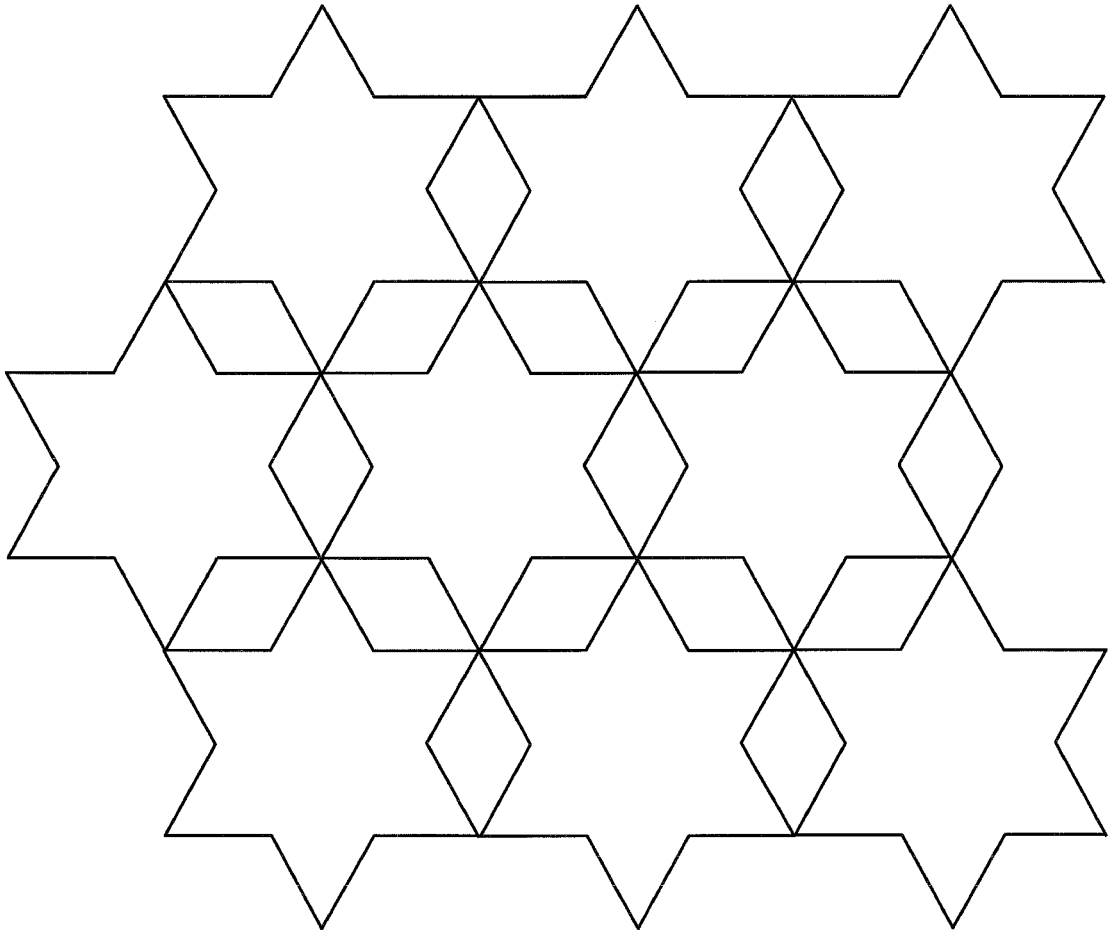

FIGS. 18 and 19 illustrate examples of six-branch-stars and parallelograms-shapes made by positioning basic geometrical shapes of six-branch-stars and parallelograms next to one another.

Figure 20:
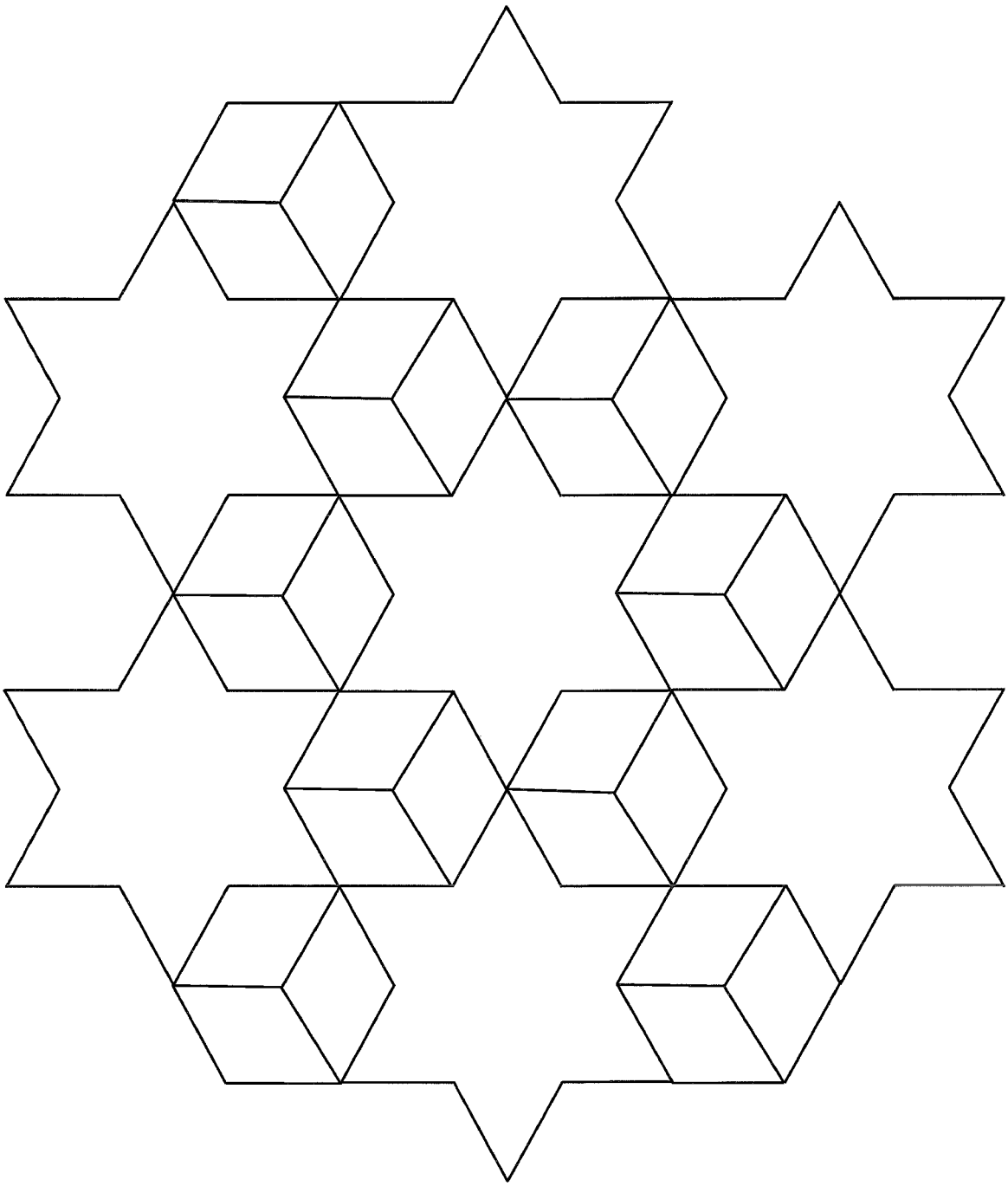

FIG. 20 illustrates an example of an six-branch-stars-cubes-shapes made by positioning basic geometrical shapes next to one another.

Figure 21:
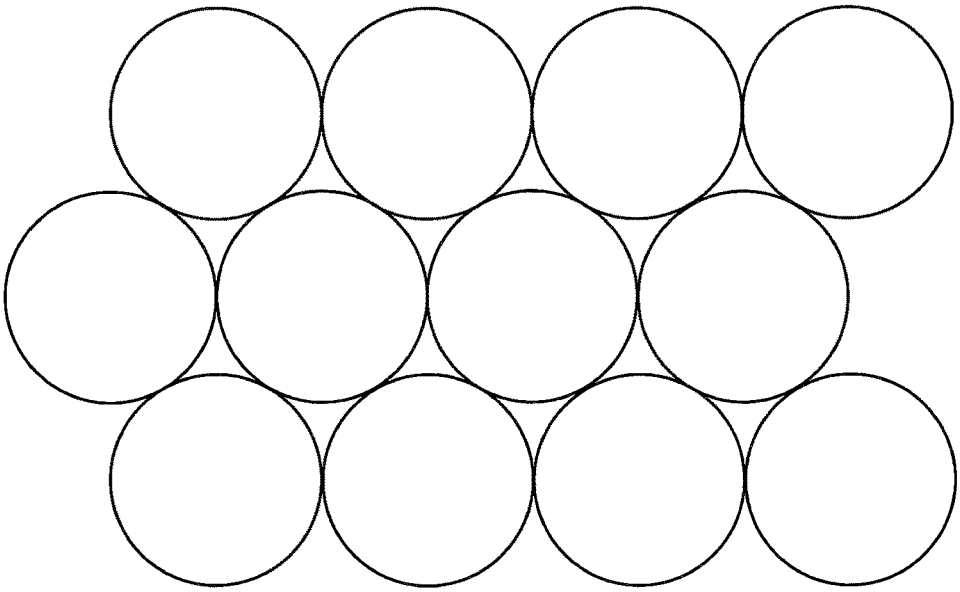
Figure 21:
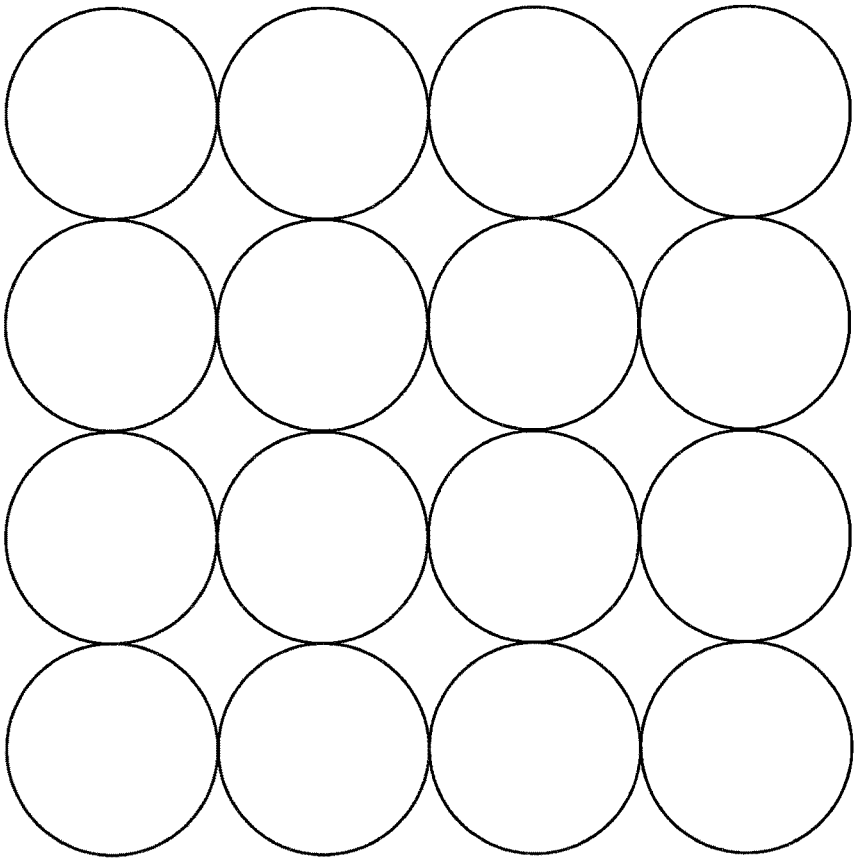

FIGS. 21(1) illustrates an example of circle-triangular-pillow-shapes made by positioning basic geometrical shapes of circles and triangular pillows next to one another and FIG. 21(2) illustrates an example of circle-square-pillows-shapes made by positioning basic geometrical shapes of circles and square pillows next to one another.

Figure 21A:
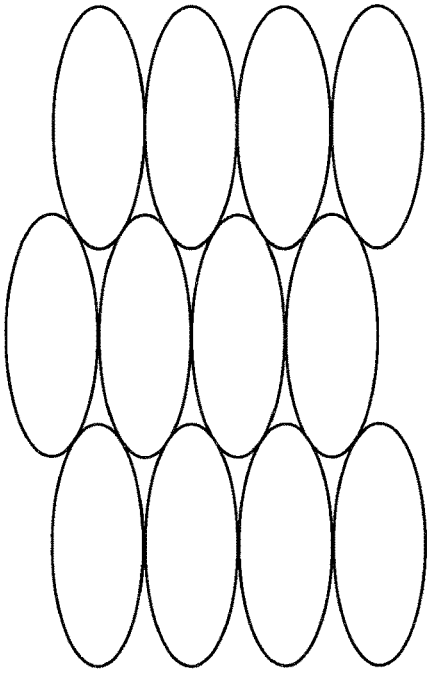
Figure 21A:
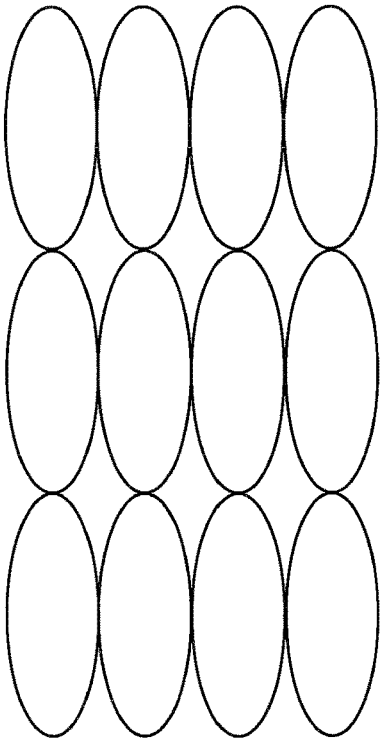

FIG. 21*a*(1) illustrates an example of an ellipse-triangle-pillow-shape made by positioning basic geometrical shapes of ellipses and triangle pillow shapes next to one another.

FIG. 21*a*(2) illustrates an example of an ellipse-square-pillow-shape made by positioning basic geometrical shapes of ellipses and square pillows shapes next to one another.

Figure 21B:
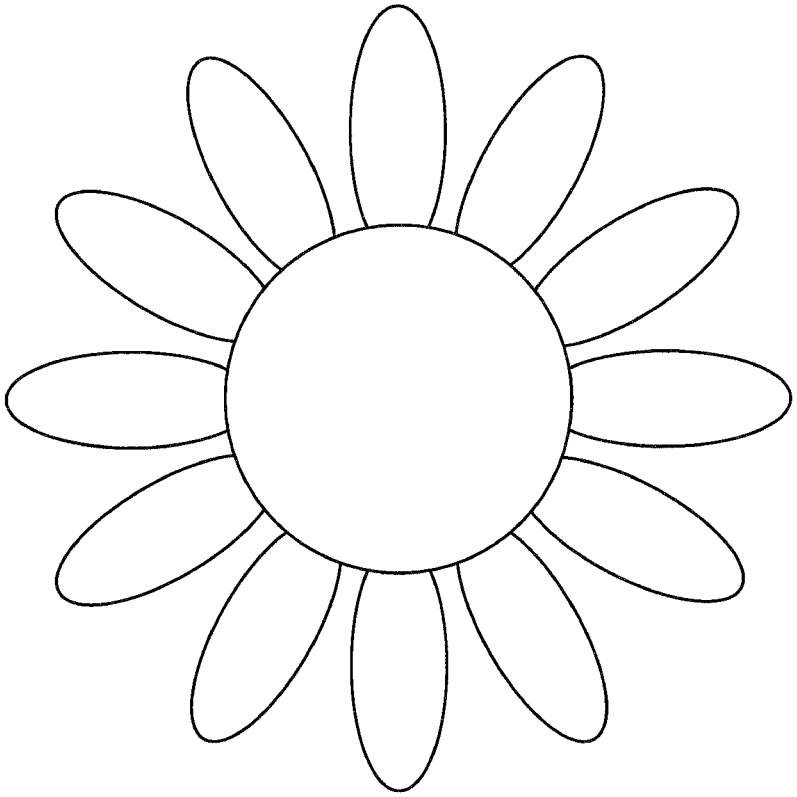

FIG. 21*b* illustrates an example of an ellipses-circle-shape—in this case a schematic flower shape—made by positioning basic geometrical shapes of ellipses and a circle next to one another.

Figure 22:
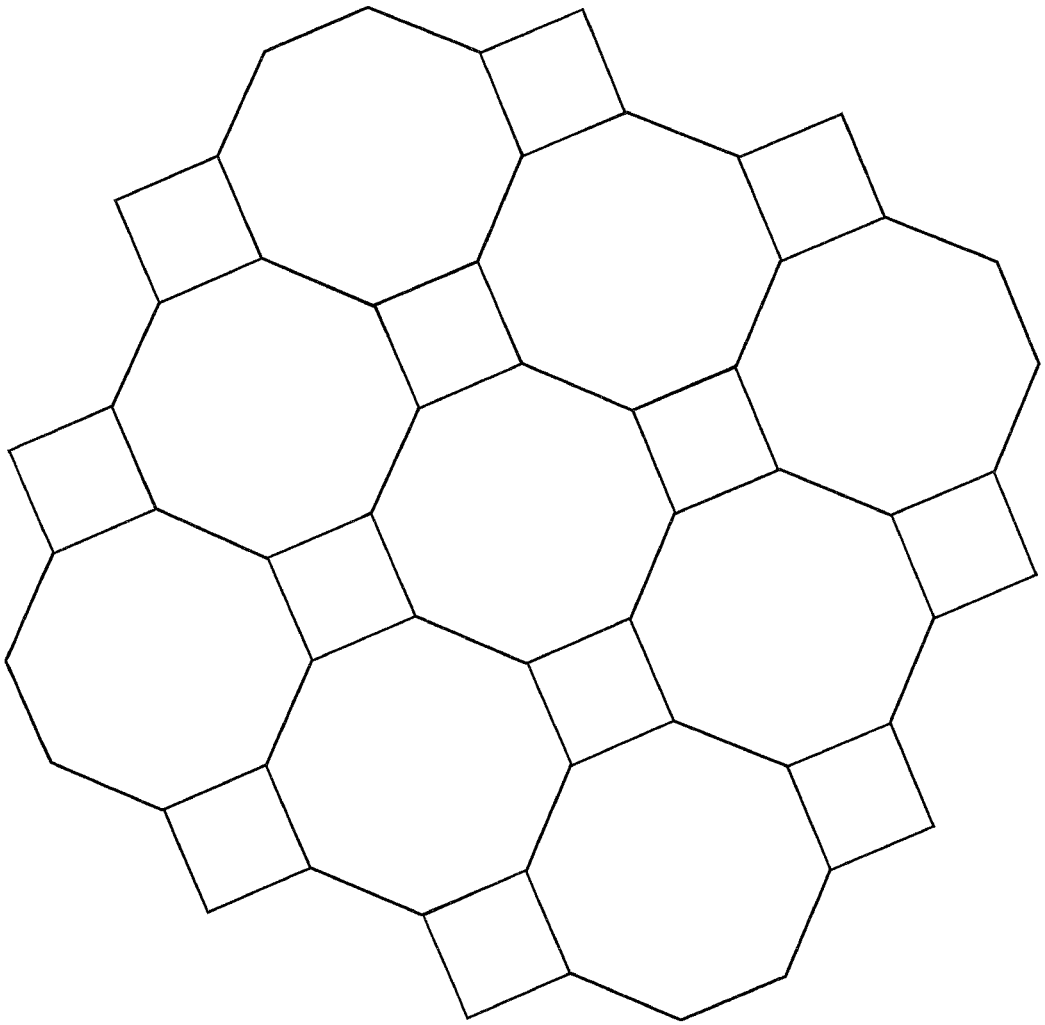

FIG. 22 illustrates an example of an octagon-square-shape made by positioning basic geometrical shapes of octagons and square next to one another.

Figure 23:
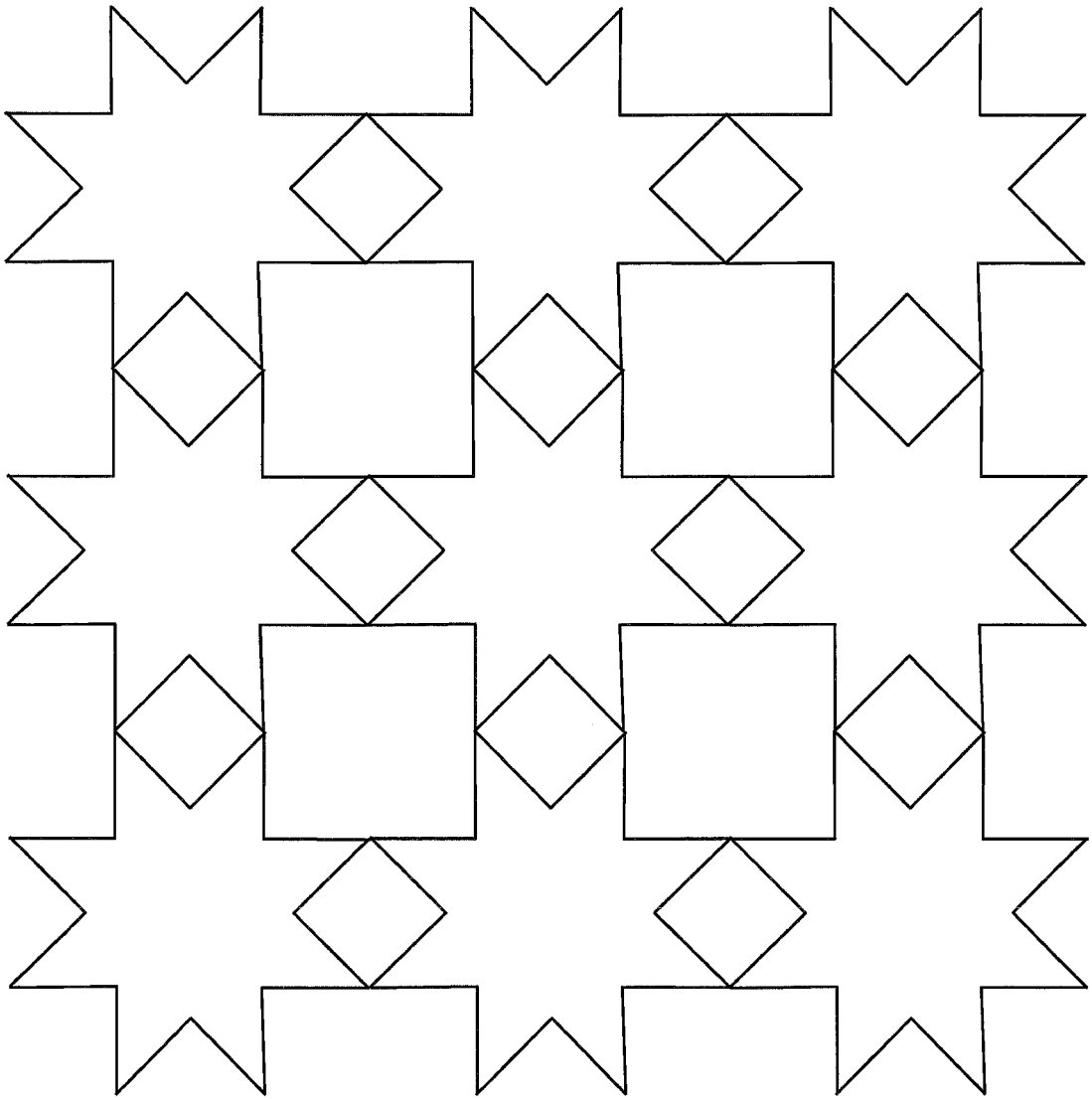

FIG. 23 illustrates an example of an eight-branch-star-square-shape made by positioning basic geometrical shapes of eight-branch stars and square next to one another.

Figure 24:
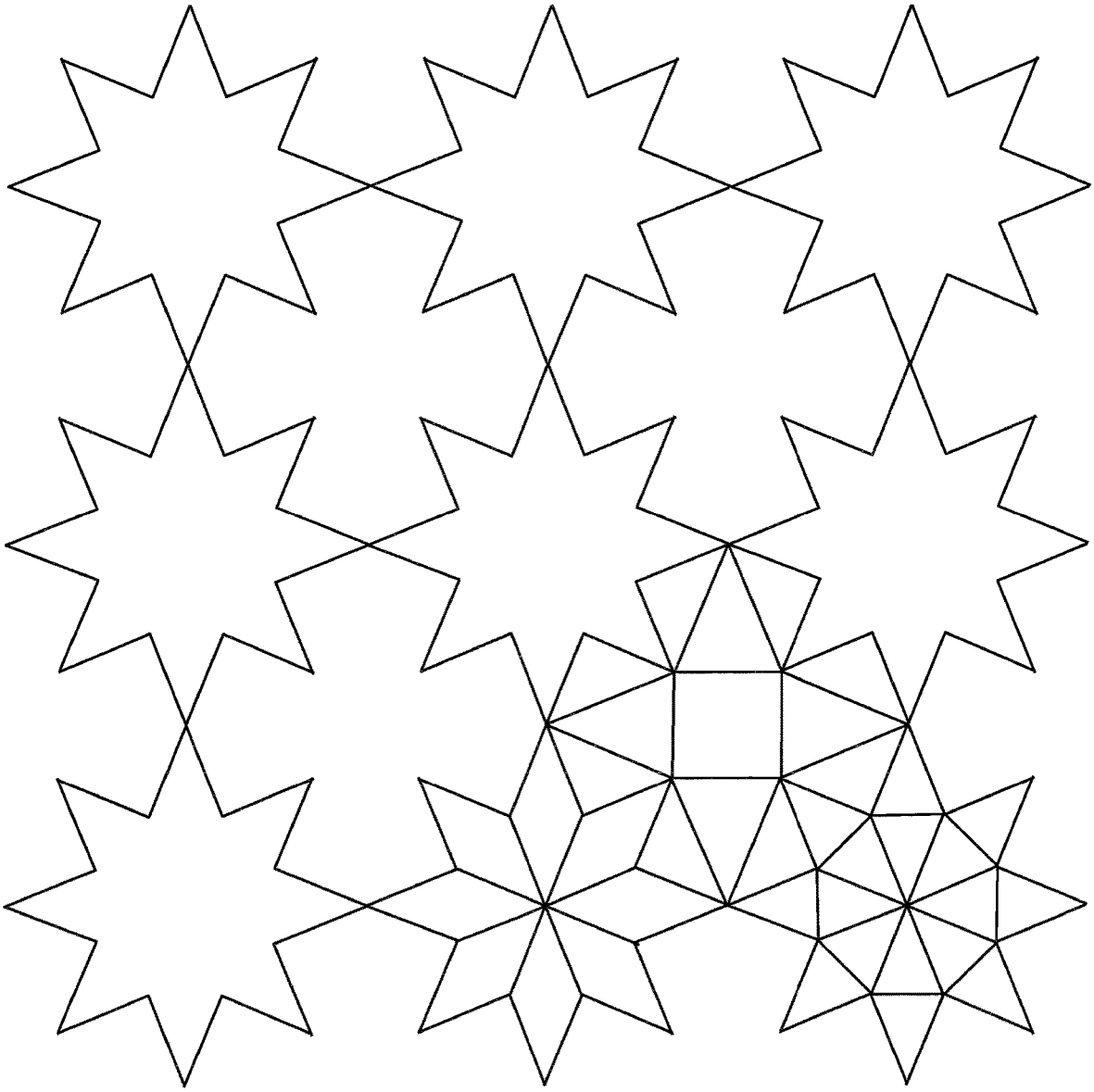

FIG. 24 illustrates an example of a clover leaf-eight-branch-star-shape made by positioning at least basic geometrical shapes of eight-branch stars next to one another.

Figure 25:
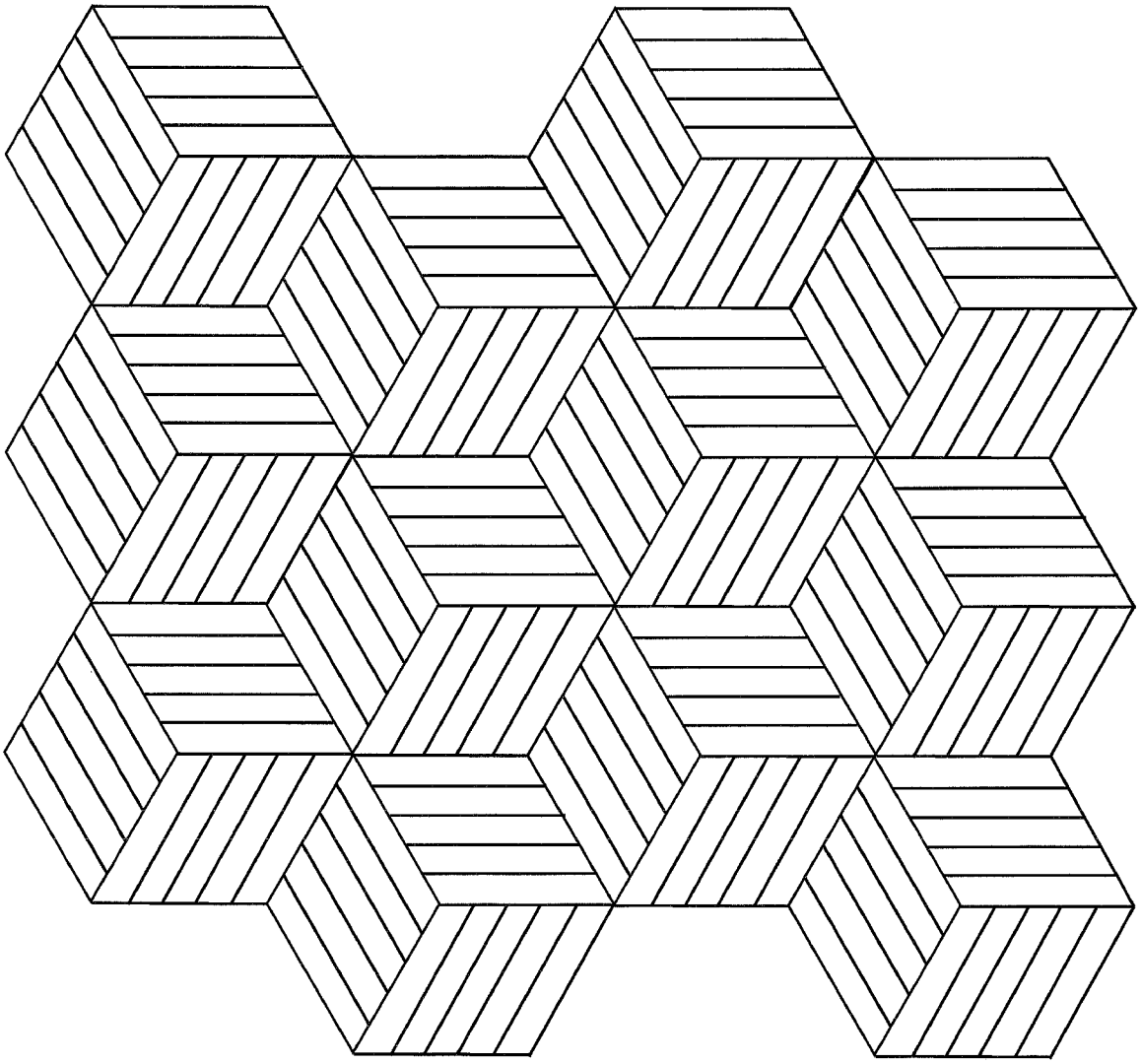

FIG. 25 illustrates an example of a 3-dimensional impression-parallelogram-cube-shape made by positioning basic geometrical shapes of parallelograms next to one another in three different orientations. The obtained shape patterns may for example be grooved or raised diffraction gratings with a same grating constant.

Figure 26:
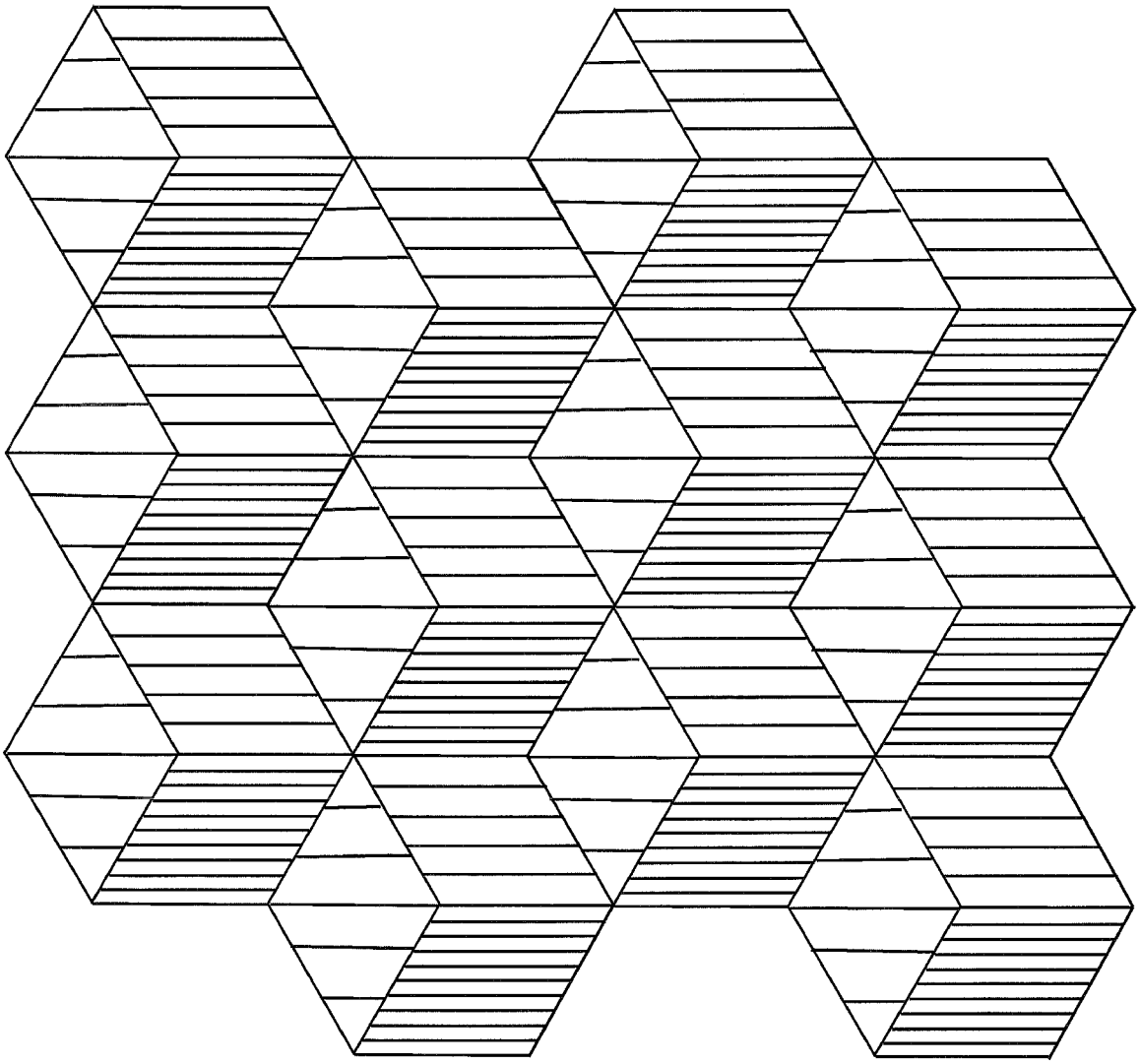

FIG. 26 illustrates an example of a 3-dimensional impression cube pattern that is made by positioning basic geometrical shapes of 3 differently orientated parallelograms with a bands patterns next to one another. The bands orientated alike may for example be groove or raised diffraction gratings with different grating constants.

Secondly we will address mask geometries.

The mask geometries are to shape laser intensity profiles—laser fluency profiles—to realize reflection-diffraction-gratings on solid matter surfaces. The mask is preferably to be positioned in the homogeneous spot of the laser beams mask projection system.

The areas in FIGS. 27-49 that are illustrated in dark represent areas of the mask that are not transparent, i.e., opaque for the laser radiation. In other words, these areas, when considered in the reduced scale of the mask projection system, are not removed by laser ablation, so that on the surface of the substrate (solid matter surface) raised parts are obtained—grating lands. The white—or bright—areas represent the transparent parts of the mask surface, i.e., these areas when considered in the reduced scale of the mask projection system, are removed by laser ablation, so that grooves—grating grooves—appear on the surface of the substrate (solid matter surface).

A number of basic geometries for diffractive gratings that may be produced through the mask projection technique, i.e., laser ablation, are shown in the following list of FIGS. 27-49.

Figure 27:
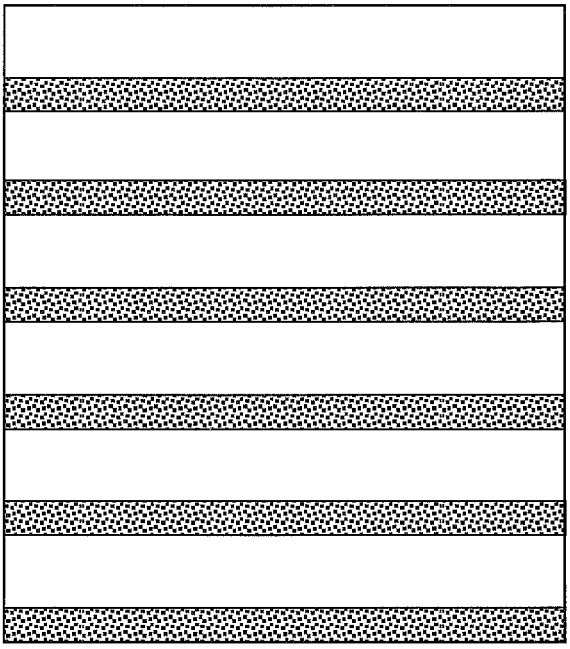
FIGS. 27 to 49 illustrate examples of mask geometries that may be used to shape laser intensity profiles to realize reflection-diffraction-gratings on solid matter surfaces.
Figure 29:
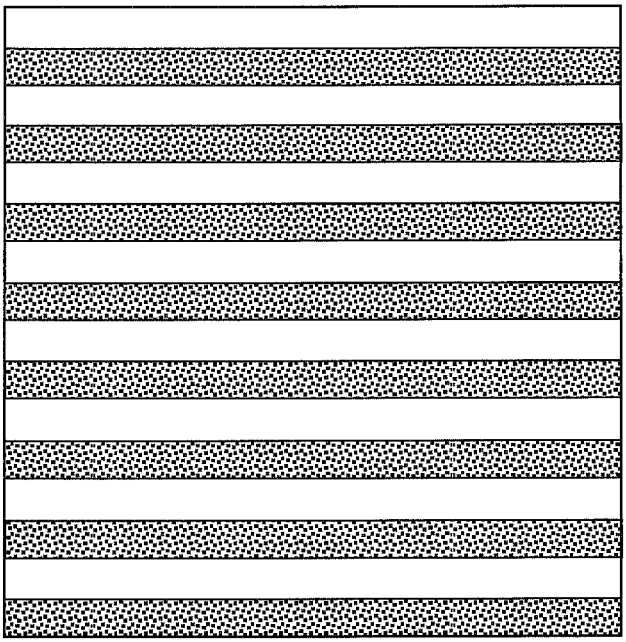

FIGS. 27 and 29 illustrate examples of parallel groove-land-structures in uniform orientation.

Figure 28:
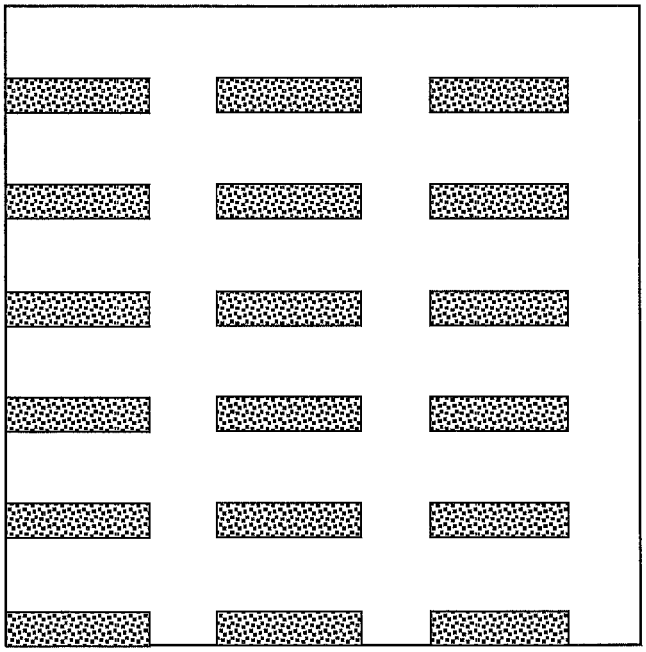

FIG. 28 illustrates an example of a parallel groove-land-structures that are interrupted.

Figure 30:
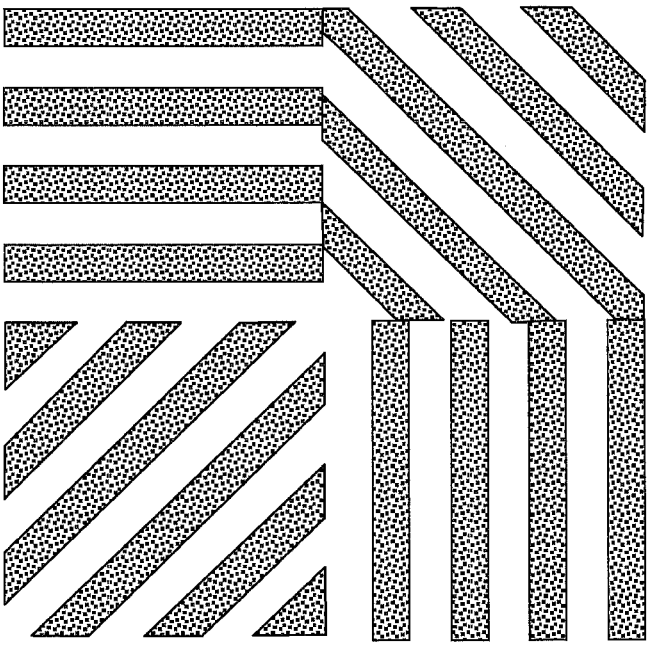

FIG. 30 illustrates an example of a plurality of groove-land structures that are rotated about a determined angle from one structure to the other.

Figure 31:
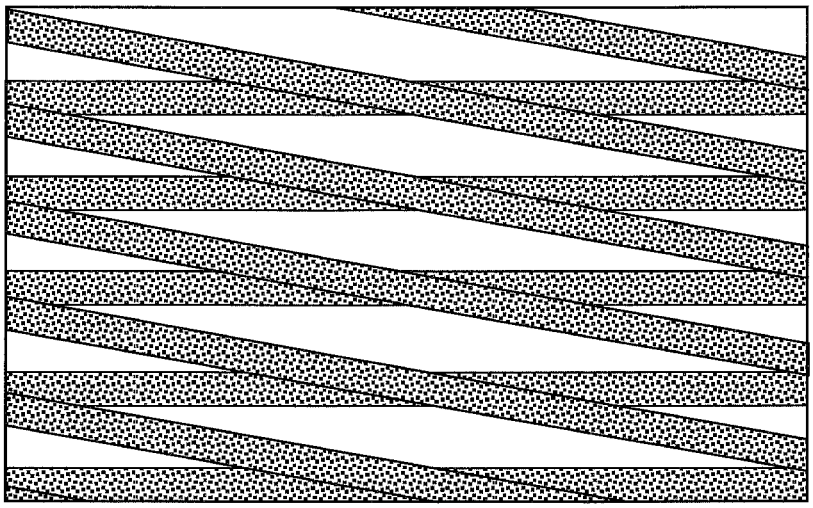
Figure 32:
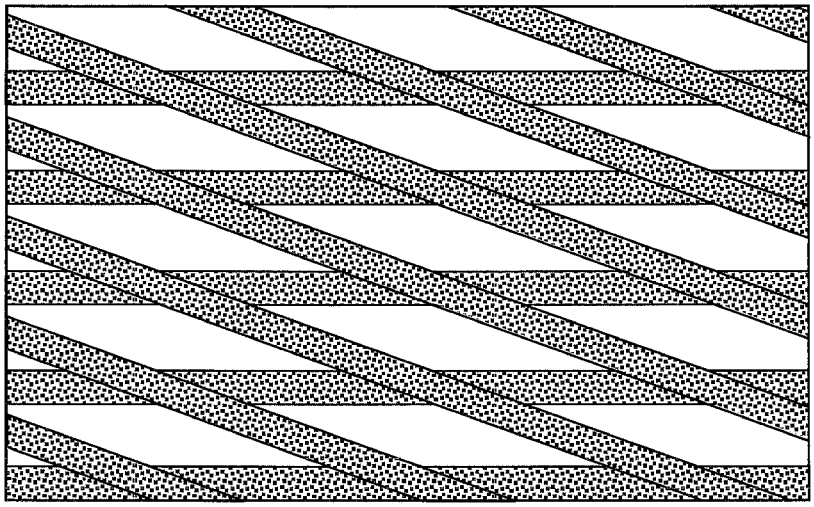
Figure 33:
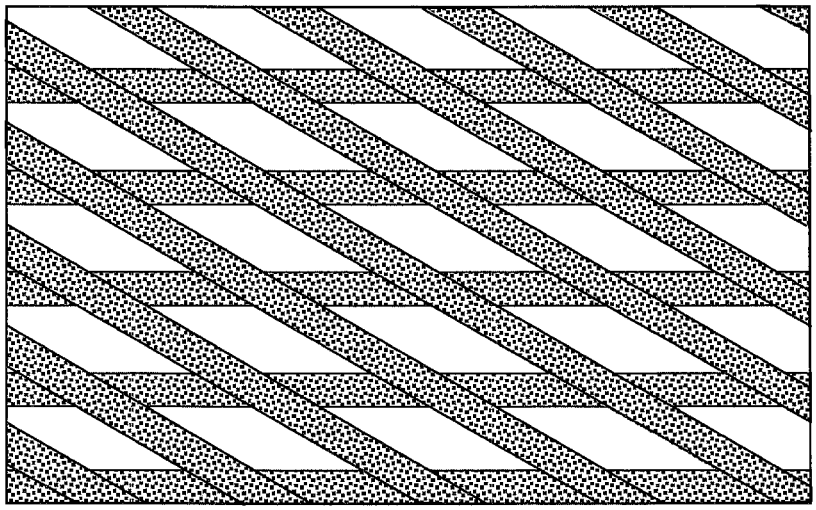

FIGS. 31 to 33 illustrate examples of parallel groove-land structures that are superposed in various angles. The double structure may be obtained by successive irradiation.

Figure 34:
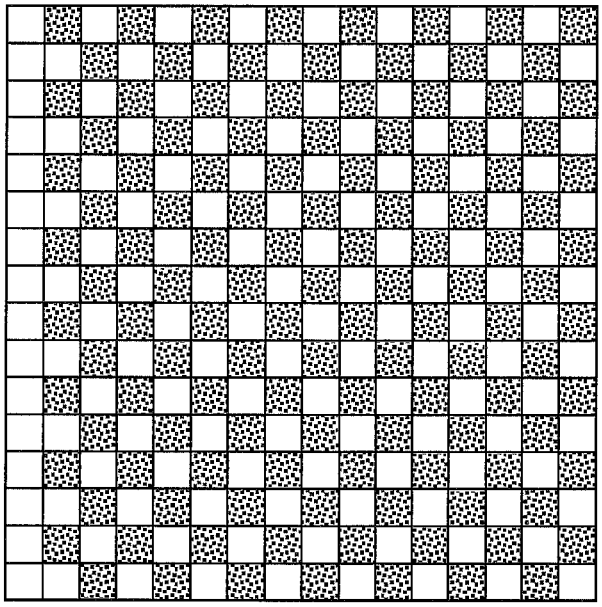
Figure 35:
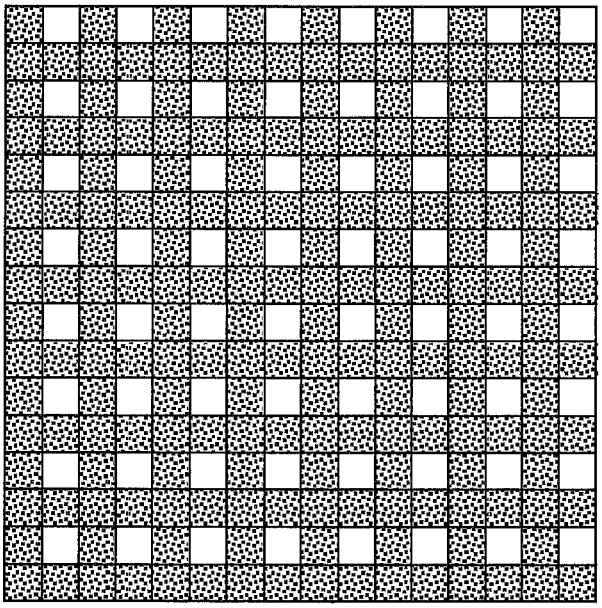

FIGS. 34 and 35 illustrate examples of square pillar structures.

Figure 36:
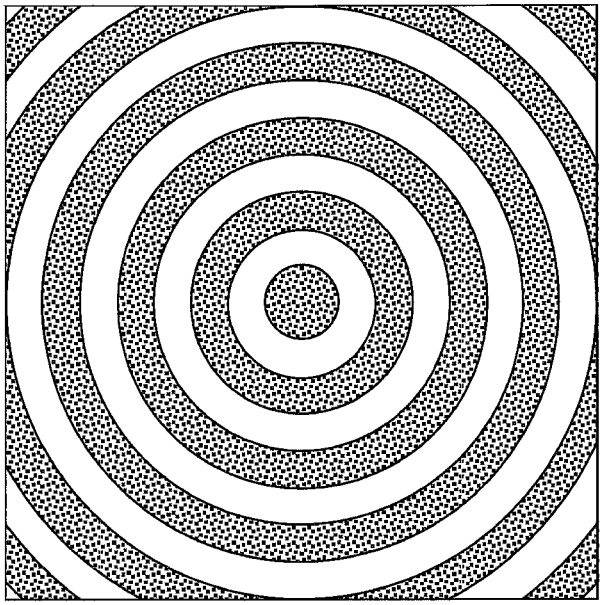
Figure 37:
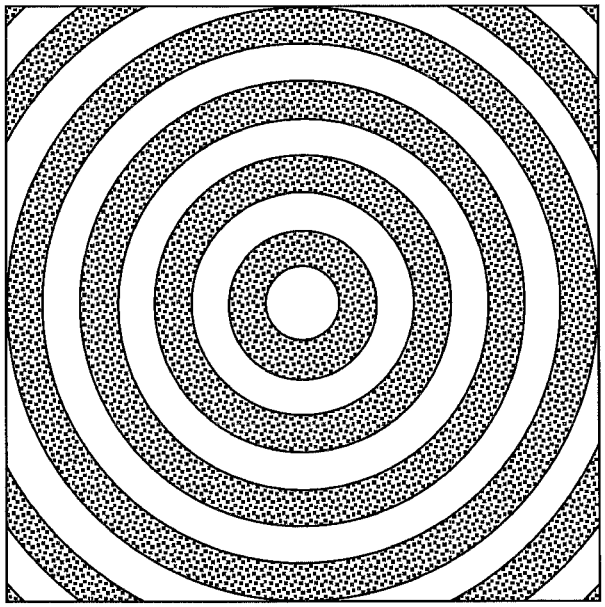

FIGS. 36 and 37 illustrate examples of ring shaped groove-land-structures that may diffract diffuse lighting in any azimuthal direction, and produce the same diffraction images on the ground of the Babinet-theorem.

Figure 38:
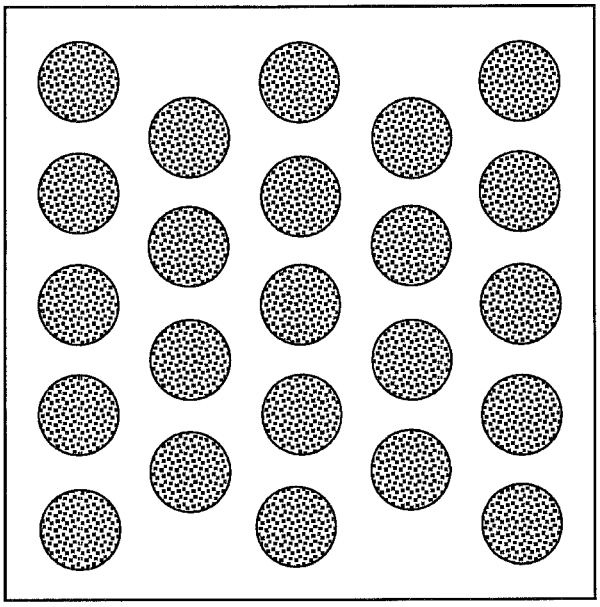
Figure 39:
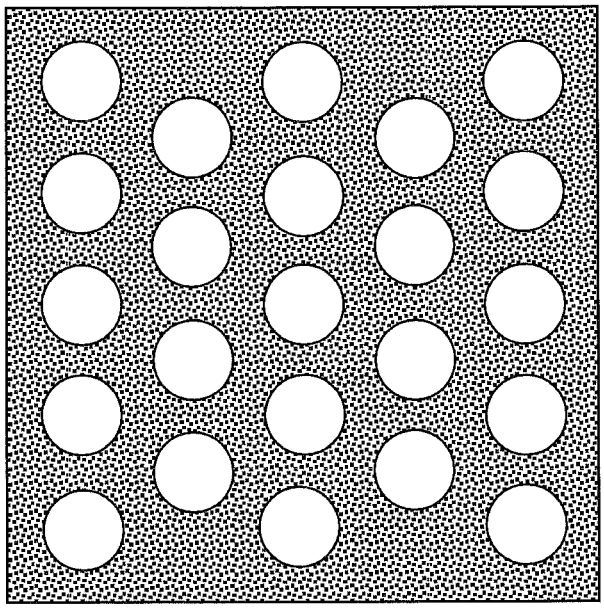

FIGS. 38 and 39 illustrate examples of cylindrical pillar or cavity structures, that may diffract in any azimuthal direction, and produce the same diffraction images on the ground of the Babinet-theorem.

Figure 40:
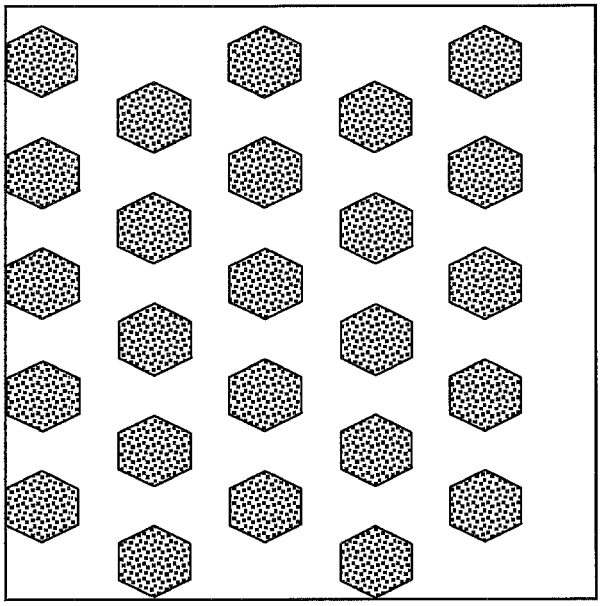
Figure 41:
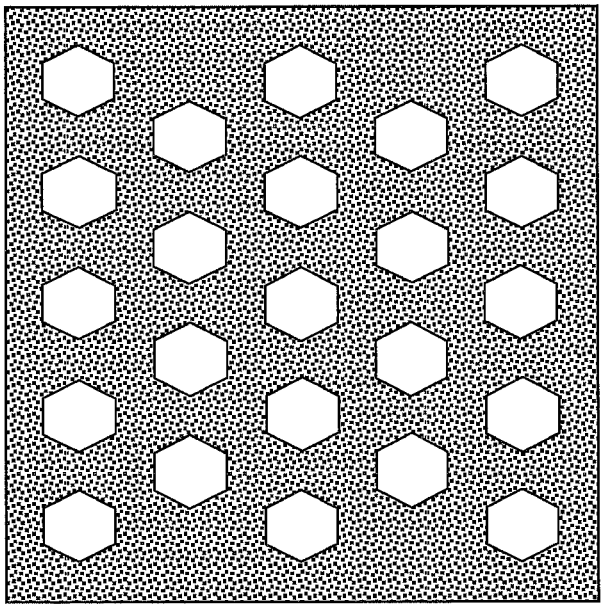

FIGS. 40 and 41 illustrate examples of hexagonal pillar or cavity structures, that may diffract diffuse light in six azimuthal directions apart respectively by a rotation of 60 degrees, and produce the same diffraction images on the ground of the Babinet-theorem.

Figure 42:
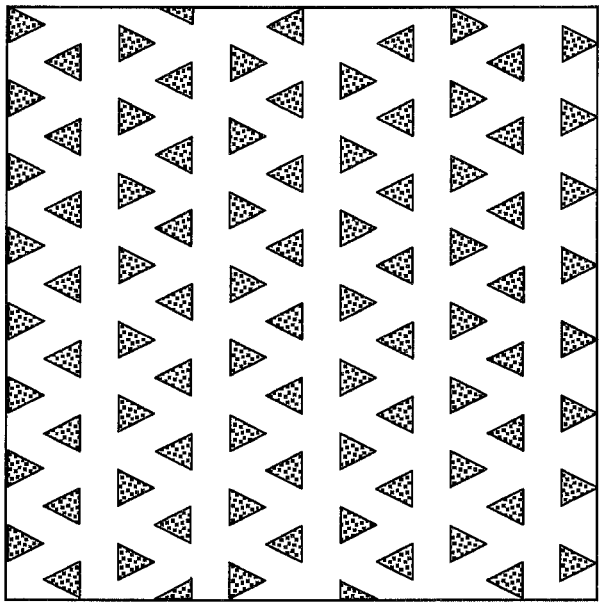
Figure 43:
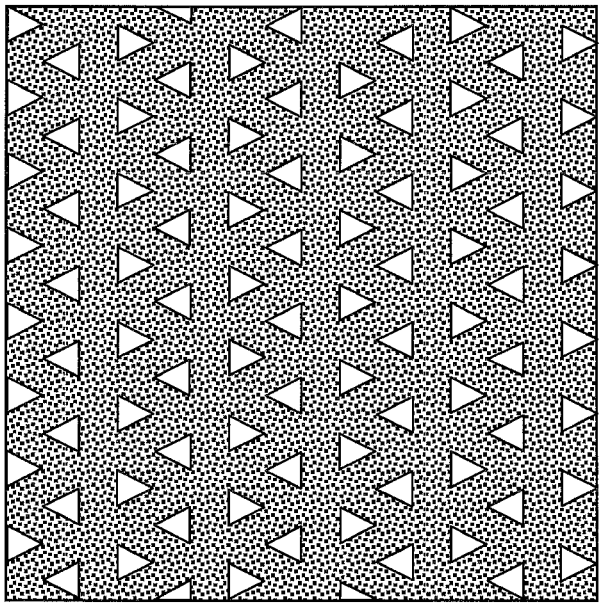
Figure 44:
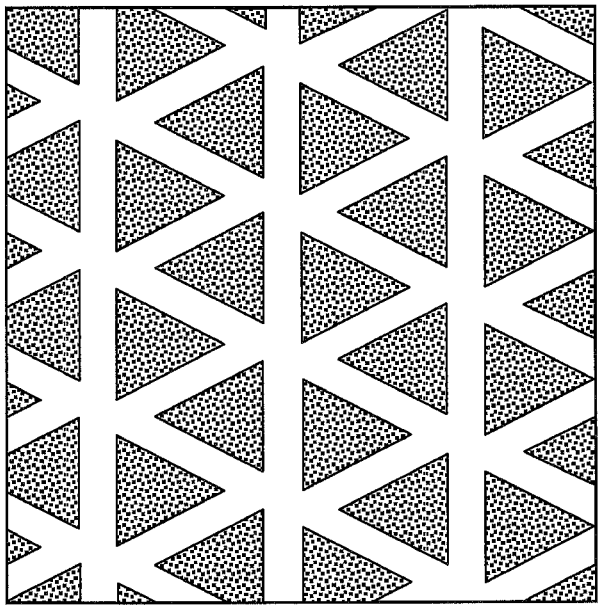
Figure 45:
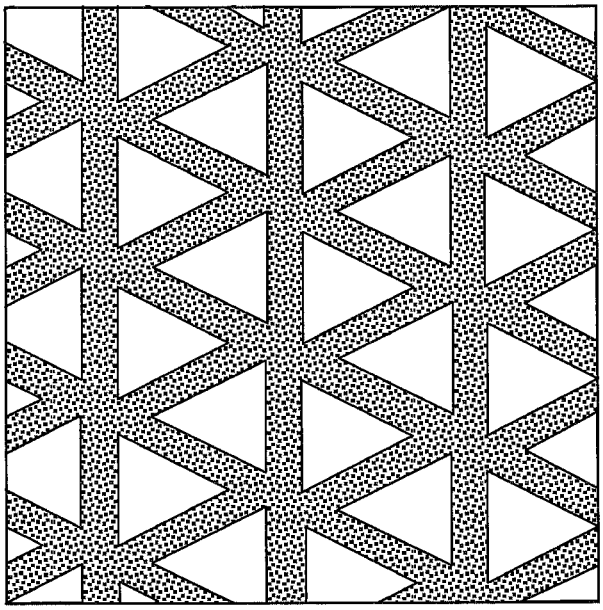

FIGS. 42 to 45 illustrate examples of triangular pillar or cavity structures of varying dimensions, that may diffract in 3 azimuthal directions apart respectively by a rotation of 120 degrees, whereby the gratings in FIGS. 42 and 43 and respectively the gratings in FIGS. 44 and 45 produce the same diffraction images on the ground of the Babinet-theorem.

Figure 46:
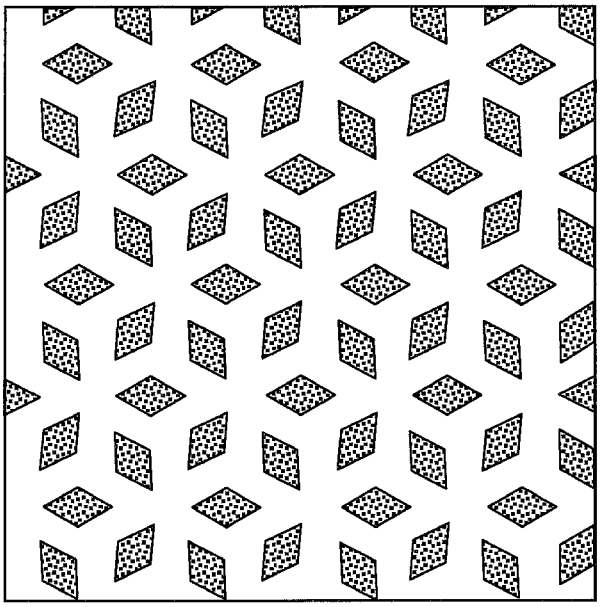
Figure 47:
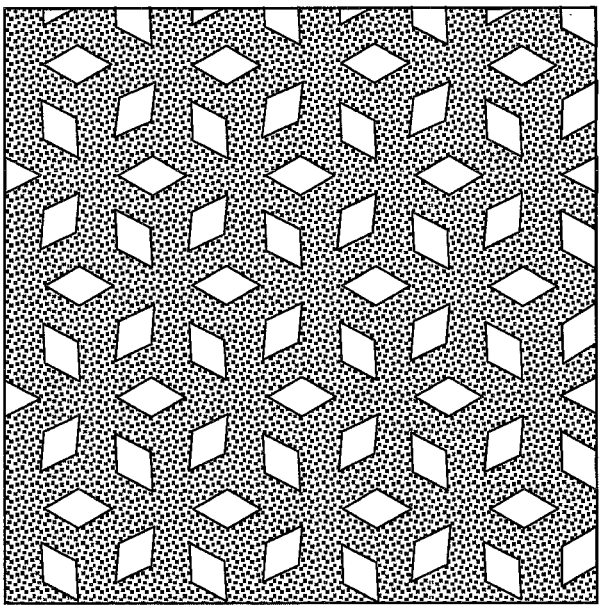
Figure 48:
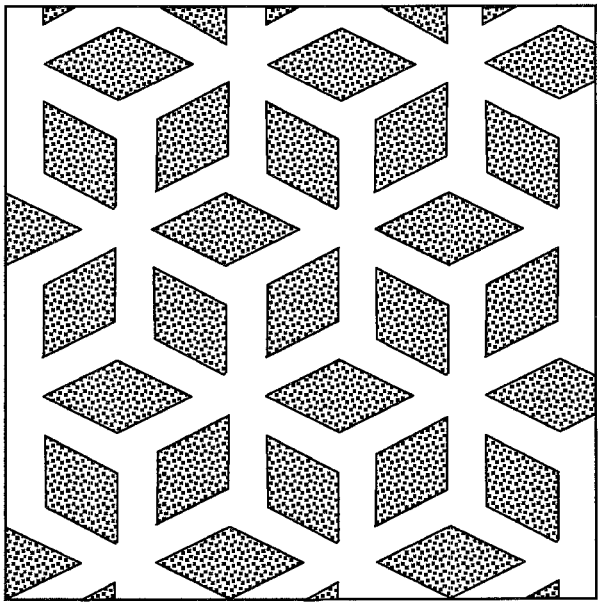
Figure 49:
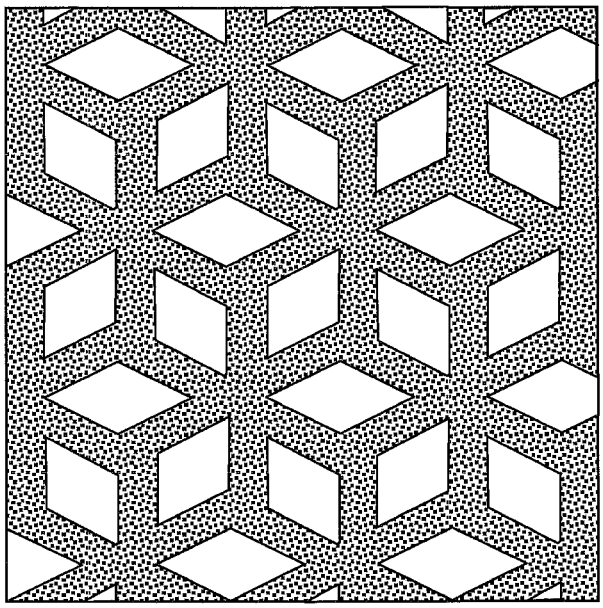

FIGS. 46 to 49 illustrate examples of parallelogram-section pillar or groove structures, that may diffract diffuse light in six azimuthal directions apart respectively by a rotation of 60 degrees, whereby the gratings in FIGS. 46 and 47, respectively the gratings in FIGS. 48 and 49 produce the same diffraction images on the ground of the Babinet-theorem.

The illustrated examples are not exhaustive of images, patterns and gratings to be engraved on the platform of the raised embossing element and then embossed in the foil and/or inner liners.

For the purpose of producing an impress, raised (land) diffraction grating structures that are obtained with mask geometries according to FIGS. 29 to 34, FIG. 36, FIG. 38, FIG. 40, FIG. 42, FIG. 44, FIG. 46 and FIG. 48, are more effective than the corresponding complementary structures that represent grooves. The complementary structures will have lesser depths than the raised structures at the same impression/embossing force, whereby the diffraction intensity is lesser too. Both structures when positioned next to each other produce a difference in contrast, whereby the raised structured are perceived as more brilliant.

The mask geometries according to FIGS. 27 to 33 and according to FIGS. 36 and 37 may also be produced as blaze gratings—multi-triangle mask or bands-mask with predetermined course/gradient of transmission curve across the two different widths of bands. For the realizing of the ring shaped grating structures according to FIGS. 36 and 37 the blaze grating mask must be rotated in steps about a predetermined angle δ, when the multi-triangle mask is used. Thereby the number of the triangular transparent areas on each circle, i.e., their distance on the arc of the circle, must be adjusted as a function of the radius in such a manner that at the time of structuring, independent from the radius and the grating grooves the same number of laser pulses impacts locally, and in this manner the same diameter of grooves is obtained for the microstructures independently from the groove radius. With circle shaped band masks with variable transparency across the two widths of bands it is possible to realize circle shaped blaze gratings without predetermined rotation of the mask, but the transparency must also decrease from the outer to the inner as the radius of the grating's grooves diminishes so that the depth of the structures of the blaze grating is independent from the radius of the grating's grooves.

The dimension of the structures of the mask geometries, e.g., grating periods of the groove structures, influence under which observation angle the orders of diffraction of individual wavelengths of the white light spectrum (the illumination of the grating) may appear. For example, to make the 3 visible parallelogram surfaces of a cube visible in various colors under the same observation angle and from a same observation direction, for a same orientation of the diffracting grating structure, for example of the grooves and lands, the period of the structure for the observation angle(s) and the desired color (for example red, green, blue) must be calculated for the respective visible surface of the cube, and accordingly differently be chosen at the time of structuring, so that the three parallelograms that make up the cube are perceived under different colors at the same angle of observation and same intensity.

When illuminating with white light of the whole structured surface, the color and intensity patterns/shapes that may be visible under same observation direction and same observation angle, are imposed by the orientations and periods of the structures of the diffracting mask structures in the surfaces of the simple or complex composed shapes of basic areas of diffraction. Herewith it is possible to generate a plurality of color patterns but also colored image representations. When inclining or rotating the whole structured surface, various corresponding color and intensity variations occur in the color patterns and the colored image representations—these can also be predetermined to some extent. It is hence possible in this manner by using linear of circular shaped arrangements of a plurality of successively moving structures of motives to make a movement of the motives appear when the whole structured surface is inclined or rotated.

According to the invention, the foils or inner liners need to be carefully selected to obtain the desired result. The latter may be described as the production of micro embossing in the foils or inner liners that enable good contrast and brilliance when the foil or inner liner is illuminated with normal daylight.

A solution has been found for the following relevant types of inner liners comprising:

- thin metal foils, e.g., aluminum foils,
- laminates made out of paper and/or plastic layers and metal foils, and metallized paper or metallized plastic films or laminates or similar substances.

With the use of raised embossing elements on rollers, and appropriately chosen patterns/logos—considering the size and the engraving—on the raised embossing elements, the invention produces best results when using for the foils and inner liners the following:

- any metal foil or plastic film laminated with paper with a grammage of about 20 to 90 g/m$^2$;
- metallized paper or metallized plastic film with a grammage of 40 to 90 g/m$^2$ or metallized plastic film with a thickness of 6 μm to 90 μm;
- the surface to be embossed of said materials may be uncoated or coated with lacquer or a slip coating; and
- the surface of said materials may be of matt or bright type and may be coloured.

It is noted that for higher grammages, e.g., a foil/paper laminate of 6.3 μm/50 g/m$^2$ and, e.g., 70 g/m$^2$ metallized paper and embossing pressure of about 60 to 80 bar is sufficient to obtain a very good embossing result.

The following parameters are important to obtain a good quality of perceived color impression at the embossed foil and inner liner:

- the intensity of the illumination, i.e., the incident beam, must be at least so strong that the reflected zero-th order R of reflected light is sufficiently intense for the human eye to see it in color with the uvula;
- the reflective surface obtained by the whole surface that is covered by diffraction gratings as in the examples shown in FIGS. 1-26 should be so small that the eye may not see it in viewing distance;
- the contrast between dark and bright parts should be at least 1:4;
- the roughness of the metal coating after the embossing is determinant for the intensity and the scattering of the reflected light. High processing pressures and badly embossed, engravings that aren't deep enough have contrary effects.

The invention claimed is:

1. A method for embossing optically diffracting microstructures in a thin foil, the embossing made by an embossing roller system including a cylindrical embossing roller and a cambered counter roller, the method comprising the steps of:

- confining the cylindrical embossing roller and the cambered counter roller in a single roller stand configured to withstand a pressure for the cylindrical embossing roller and the cambered counter roller,
- a surface of the cylindrical embossing roller having a raised embossing element configured for microstructure embossing, the raised embossing element includes a platform distant at a height d in a range between 5 μm and 30 μm above a surrounding surface of the embossing roller, and a pattern engraved on top of the platform, the pattern including the optically diffracting microstructures with periodicity of gratings in a range smaller than 30 μm that produce from a diffuse or directed source of light in a visible wavelength range diffraction images with high contrast and high luminosity in a defined observation angle;
- adjusting a pressure for the cylindrical embossing roller on the thin foil in a range less than 80 bar relative to a platform area of approximately 100 mm$^2$; and
- embossing the optically diffracting microstructures to the thin foil, the thin foil including a metal foil or a plastic film laminated with paper with a grammage of about 20 g/m$^2$ to 90 g/m$^2$.

2. The method of claim 1, wherein the single roller stand further includes an additional cylindrical embossing roller, and further comprising

- providing on a surface of the additional cylindrical embossing roller a macro-pattern arranged to emboss satinating macro-structures on the thin foil.

3. The method of claim 2, wherein the macro-pattern is obtained by a pin-up, pin-up embossing.

4. The method of claim 1, wherein the optically diffracting microstructures include structures of a size between 0.3 μm and 2 μm.

5. The method of claim 1, wherein the embossing pressure is between 60 bar and 80 bar relative to the platform area of approximately 100 mm$^2$.

6. An embossing roller system for embossing optically diffracting microstructures in a thin foil, the embossing roller system including at least one cylindrical embossing roller and a cambered counter roller,

- wherein the at least one cylindrical embossing roller and the cambered counter roller are confined in a single roller stand to withstand a pressure for the at least one cylindrical embossing roller and the cambered counter roller, wherein on a surface of a first one of the at least one cylindrical embossing rollers at least one raised embossing element is arranged that is configured for microstructure embossing, one of the at least one raised embossing elements includes a platform distant at a height d in a range between 5 μm and 30 μm above a surrounding surface of the cylindrical embossing roller, and a pattern engraved on top of the platform, the pattern including the optically diffracting microstructures with periodicity of gratings in a range smaller than 30 μm that produce from a diffuse or directed source of light in a visible wavelength range diffraction images with high contrast and high luminosity in a defined observation angle; and wherein a pressure for the at least one cylindrical embossing roller on the thin foil is adjusted to a range less than 80 bar relative to a platform area of approximately 100 $mm^2$.

7. The system of claim 6, wherein on a surface of an additional cylindrical embossing roller a macro-pattern is provided, arranged to emboss satinating macro-structures on the thin foil.

8. The system of claim 7, wherein the macro-pattern is obtained by a pin-up, pin-up embossing.

9. The embossing roller system of claim 6, wherein the optically diffracting microstructures include structures of a size between 0.3 μm and 2 μm.

10. The embossing roller system of claim 6, wherein the embossing pressure is between 60 bar and 80 bar relative to the platform area of approximately 100 $mm^2$.

11. A method for embossing optically diffracting microstructures in a thin foil, the embossing made by an embossing roller system including a cylindrical embossing roller and a cambered counter roller, the method comprising the steps of:

confining the cylindrical embossing roller and the cambered counter roller in a single roller stand configured to withstand a pressure for the cylindrical embossing roller and the cambered counter roller, a surface of the cylindrical embossing roller having a raised embossing element configured for microstructure embossing, the raised embossing element includes a platform distant at a height d in a range between 5 μm and 30 μm above a surrounding surface of the embossing roller, and a pattern engraved on top of the platform, the pattern including the optically diffracting microstructures with periodicity of gratings in a range smaller than 30 μm that produce from a diffuse or directed source of light in a visible wavelength range diffraction images with high contrast and high luminosity in a defined observation angle;

adjusting a pressure for the cylindrical embossing roller on the thin foil in a range less than 80 bar relative to a platform area of approximately 100 $mm^2$; and embossing the optically diffracting microstructures to the thin foil, the thin foil including a metallized paper or metallized plastic film with a grammage of 40 $g/m^2$ to 90 $g/m^2$.

12. The method of claim 11, wherein the optically diffracting microstructures include structures of a size between 0.3 μm and 2 μm.

13. The method of claim 11, wherein the embossing pressure is between 60 bar and 80 bar relative to the platform area of approximately 100 $mm^2$.

14. A method for embossing optically diffracting microstructures in a thin foil, the embossing made by an embossing roller system including a cylindrical embossing roller and a cambered counter roller, the method comprising the steps of:

confining the cylindrical embossing roller and the cambered counter roller in a single roller stand configured to withstand a pressure for the cylindrical embossing roller and the cambered counter roller, a surface of the cylindrical embossing roller having a raised embossing element configured for microstructure embossing, the raised embossing element includes a platform distant at a height d in a range between 5 μm and 30 μm above a surrounding surface of the embossing roller, and a pattern engraved on top of the platform, the pattern including the optically diffracting microstructures with periodicity of gratings in a range smaller than 30 μm that produce from a diffuse or directed source of light in a visible wavelength range diffraction images with high contrast and high luminosity in a defined observation angle;

adjusting a pressure for the cylindrical embossing roller on the thin foil in a range less than 80 bar relative to a platform area of approximately 100 $mm^2$; and embossing the optically diffracting microstructures to the thin foil, the thin foil including a metallized plastic film with a thickness of 6 μm to 90 μm.

15. The method of claim 14, wherein the optically diffracting microstructures include structures of a size between 0.3 μm and 2 μm.

16. The method of claim 14, wherein the embossing pressure is between 60 bar and 80 bar relative to the platform area of approximately 100 $mm^2$.

* * * * *